US011672360B2

(12) United States Patent
Day et al.

(10) Patent No.: US 11,672,360 B2
(45) Date of Patent: Jun. 13, 2023

(54) BALL DISPLAY CASE

(71) Applicant: Inducomp Corporation, Pacific, MO (US)

(72) Inventors: David Day, Pacific, MO (US); John T. Weldon, Pacific, MO (US)

(73) Assignee: Inducomp Corporation, Pacific, MO (US)

( * ) Notice: Subject to any disclaimer, the term of this patent is extended or adjusted under 35 U.S.C. 154(b) by 491 days.

(21) Appl. No.: 16/287,693

(22) Filed: Feb. 27, 2019

(65) Prior Publication Data

US 2020/0268174 A1 Aug. 27, 2020

(51) Int. Cl.
*A47F 3/14* (2006.01)
*B65D 43/02* (2006.01)

(52) U.S. Cl.
CPC ..... *A47F 3/145* (2013.01); *B65D 43/0208* (2013.01)

(58) Field of Classification Search
CPC ..... A47F 3/145; B65D 43/0208; B65D 81/07; B65D 81/075
USPC ..... 206/315.9, 315.91, 734, 765, 486, 564, 206/583, 587, 806, 756, 770
See application file for complete search history.

(56) References Cited

U.S. PATENT DOCUMENTS

| | | | | | |
|---|---|---|---|---|---|
| 2,889,920 | A * | 6/1959 | Andress | B65D 81/07 | 206/423 |
| 3,392,824 | A * | 7/1968 | Flynn | B65D 81/07 | 206/594 |
| 5,082,110 | A * | 1/1992 | Hager | A63B 47/00 | 206/232 |
| 5,918,393 | A * | 7/1999 | Martell | A47G 1/12 | 40/1 |
| 6,029,829 | A * | 2/2000 | Ovadia | A47F 7/02 | 206/566 |
| 6,932,212 | B2 * | 8/2005 | Ovadia | A47F 7/02 | 206/482 |
| 2003/0085151 | A1 * | 5/2003 | Cleaver | B65D 81/07 | 206/723 |
| 2010/0213087 | A1 * | 8/2010 | Weldon | A63B 47/00 | 206/315.9 |
| 2016/0049319 | A1 * | 2/2016 | Thomas | H01L 21/6732 | 206/710 |

* cited by examiner

*Primary Examiner* — Robert Poon
(74) *Attorney, Agent, or Firm* — Stinson LLP

(57) ABSTRACT

A base assembly for a ball display case includes a base configured to support the display case on a surface. A pedestal is supported by the base and configured to support the ball in the display case. The pedestal includes a platform for seating the ball in the display case. The platform includes a spring configured to yield when contacted by the ball in the display case.

9 Claims, 23 Drawing Sheets

BALL DISPLAY CASE

FIELD OF INVENTION

The present invention relates generally to a case for displaying and protecting an item of sports memorabilia and more particularly to a case for displaying and protecting a ball, such as a valuable autographed ball.

BACKGROUND

The value of a ball or other item of sports memorabilia can be substantial if it is autographed or if it was involved in an event of historical significance. For example, a baseball autographed by Babe Ruth in average condition can sell for about $25,000. Some people may also want to keep a ball or other item as souvenir for personal reasons that do not necessarily translate into a high market value for the item. It is sometimes worthwhile to protect these prized items from degradation to preserve their condition. In the case of a high market value item, the value can be affected by the item's condition. Sometimes the owner of an item will have a memorabilia expert examine it to certify its authenticity and grade its condition. The expert's certification is more meaningful if there are assurances the certified item has not been replaced with a fake and that its condition has not deteriorated in the time since it was previously examined by the expert.

Various display cases are available for displaying baseballs and other sports memorabilia. For example, U.S. Pat. No. 5,165,538 (Peters) discloses a baseball holder in which a baseball is held in the space between two hemispherical shells that cover and protect the baseball. U.S. Pub. Pat. App. No. 20080067086 (Uidl) discloses a baseball display case in which a baseball is supported under a protective dome on a support that can be rotated by a motor so the baseball rotates under the dome. U.S. Pat. No. 5,082,110 (Hager) discloses a protective case for an autographed baseball in which a transparent dome is fused to a baseplate by sonic welding or dielectric heating to hermetically seal the baseball in the case and protect against tampering. The Hager patent discloses that an appraisal and authentication service can seal a documentation card between layers of the base plate when the dome is fused to the base plate to display information about the baseball, such as authentication and grading information.

The present inventors have developed various improvements to cases for displaying prized pieces of sports memorabilia while protecting them against degradation and/or tampering.

SUMMARY

In one aspect, a base assembly for a ball display case generally comprises a base configured to support the display case on a surface. A pedestal is supported by the base and configured to support a ball in the display case. The pedestal includes a platform for seating the ball in the display case. The platform includes a spring configured to yield when contacted by the ball in the display case In another aspect, a ball display case generally comprises a base configured to support the display case on a surface. A pedestal is supported by the base and configured to support a ball in the display case. The pedestal includes a platform for seating the ball in the display case. The platform includes a spring configured to yield when contacted by the ball in the display case. A cover is supported by the base for covering the ball in the display case.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
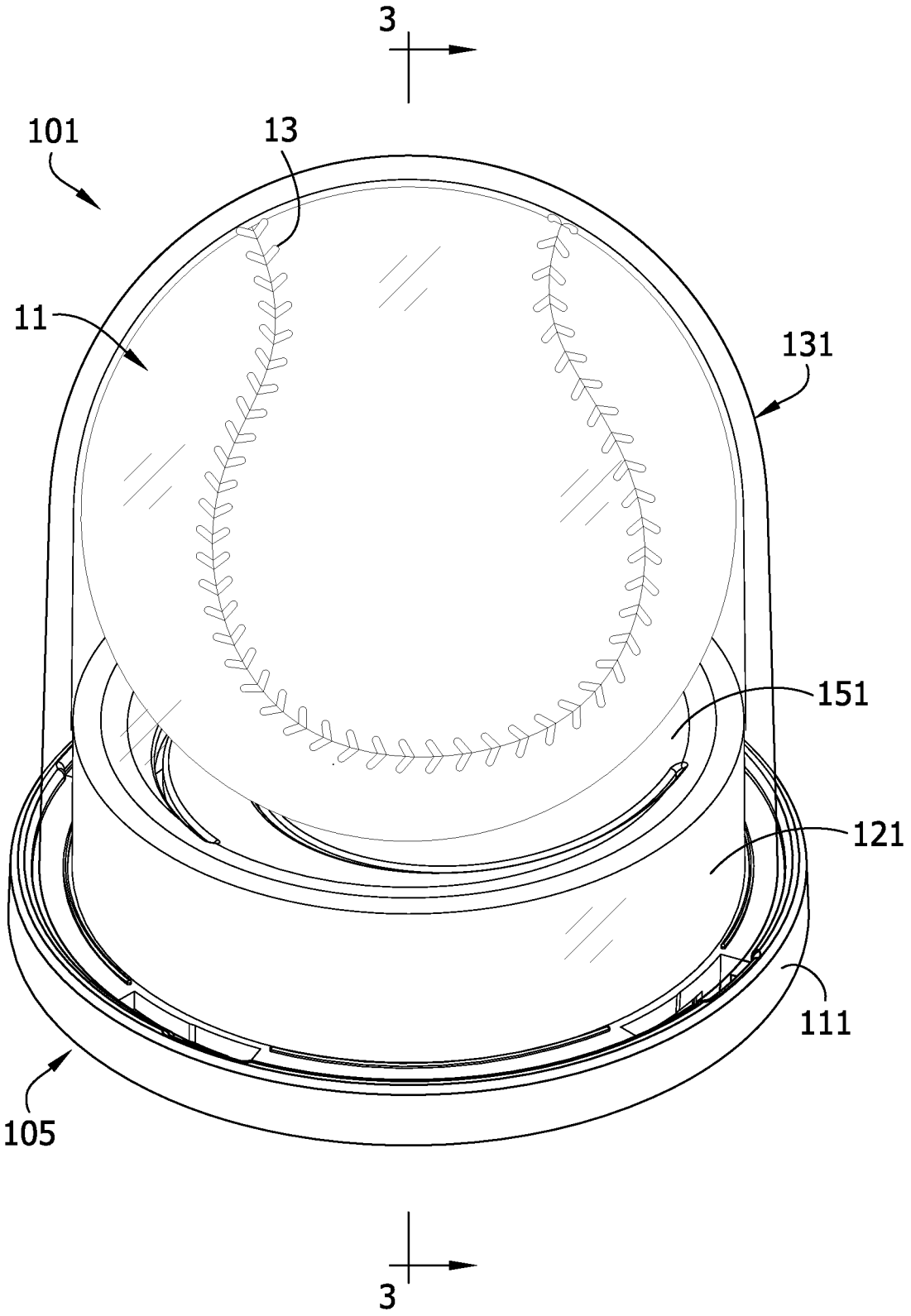
FIG. 1 is a perspective of an exemplary embodiment of a ball display case displaying a baseball.
Figure 2A:
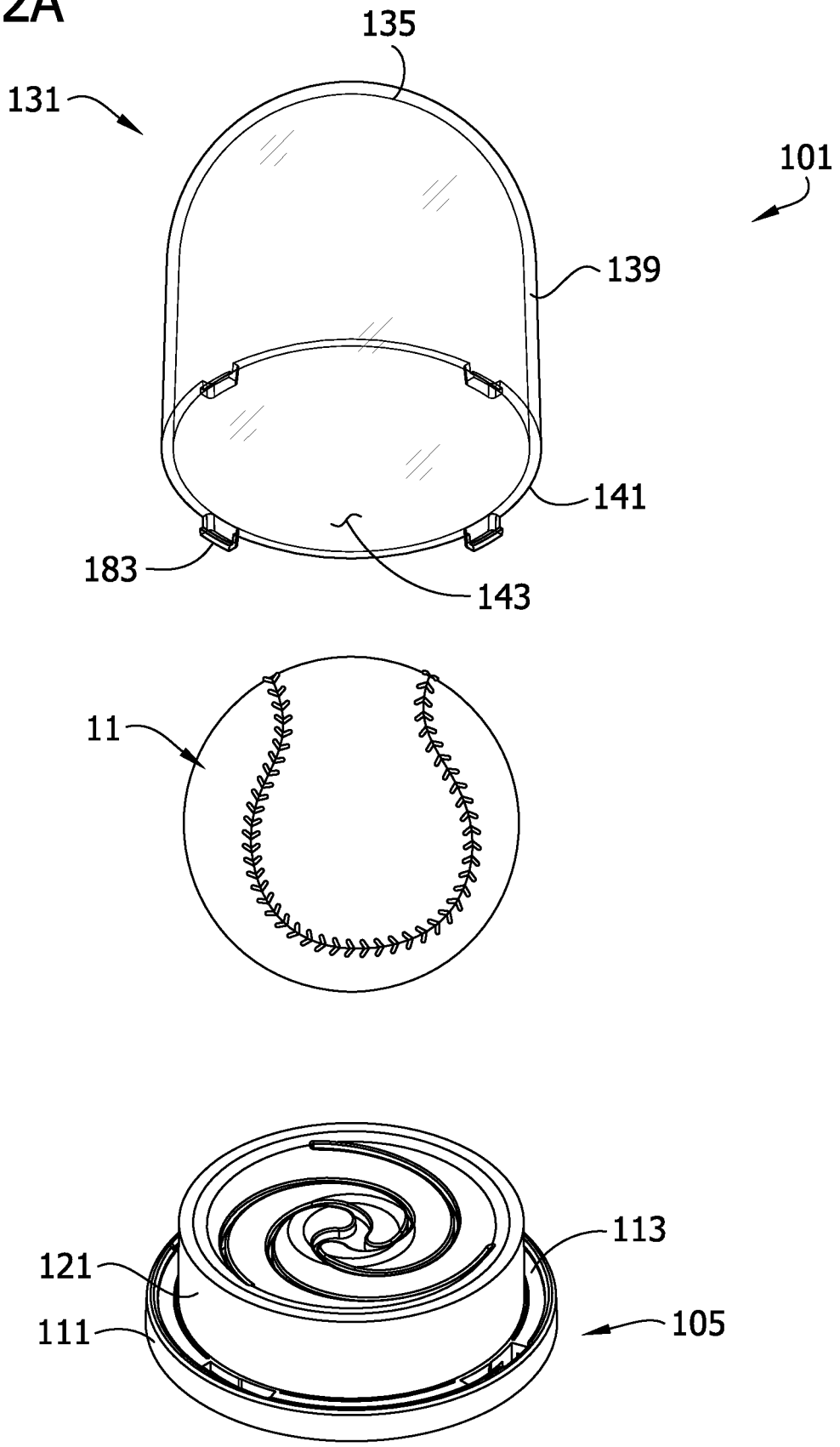
FIG. 2A is an exploded top perspective of the ball display case.
Figure 2B:
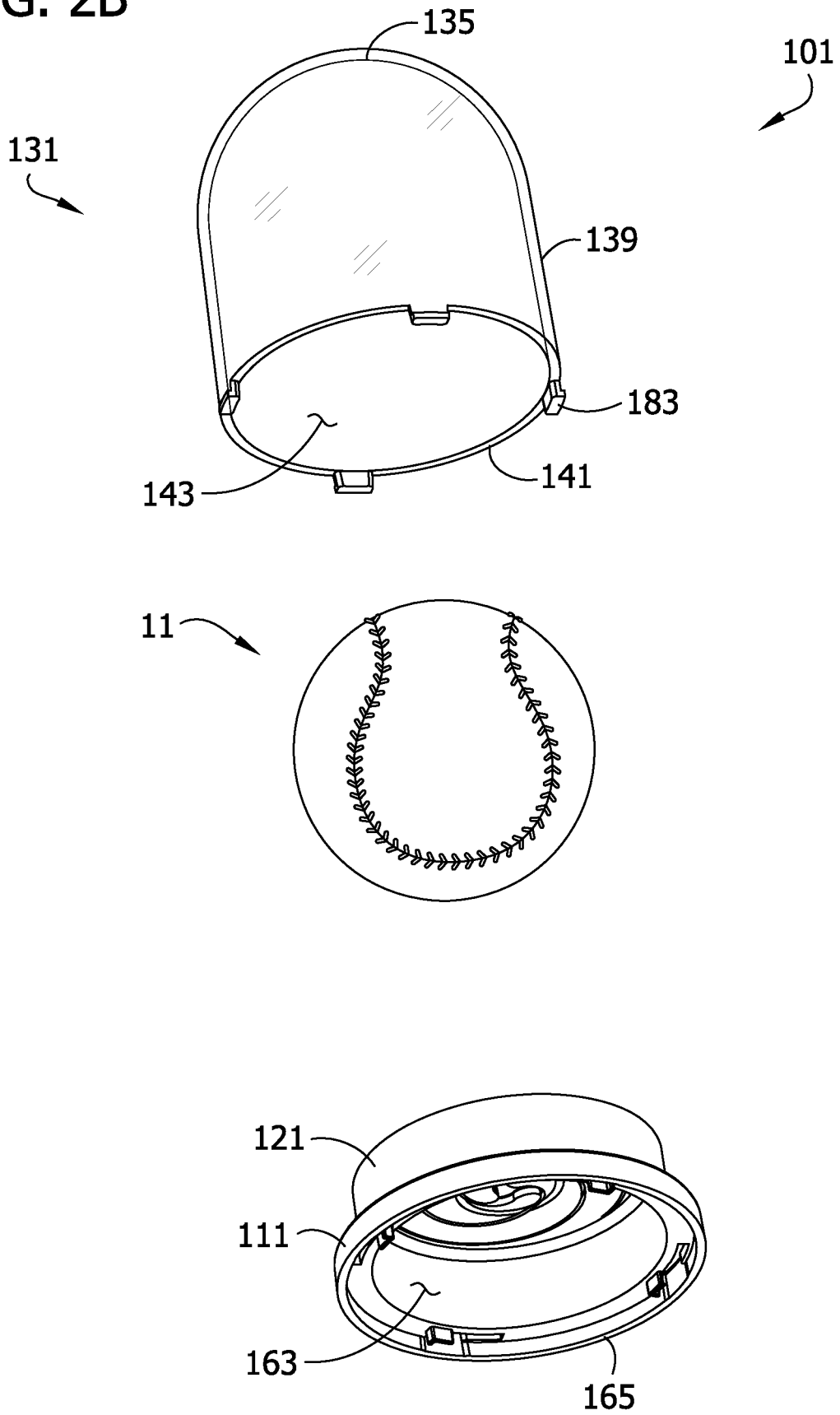
FIG. 2B is an exploded bottom perspective of the ball display case.
Figure 3:
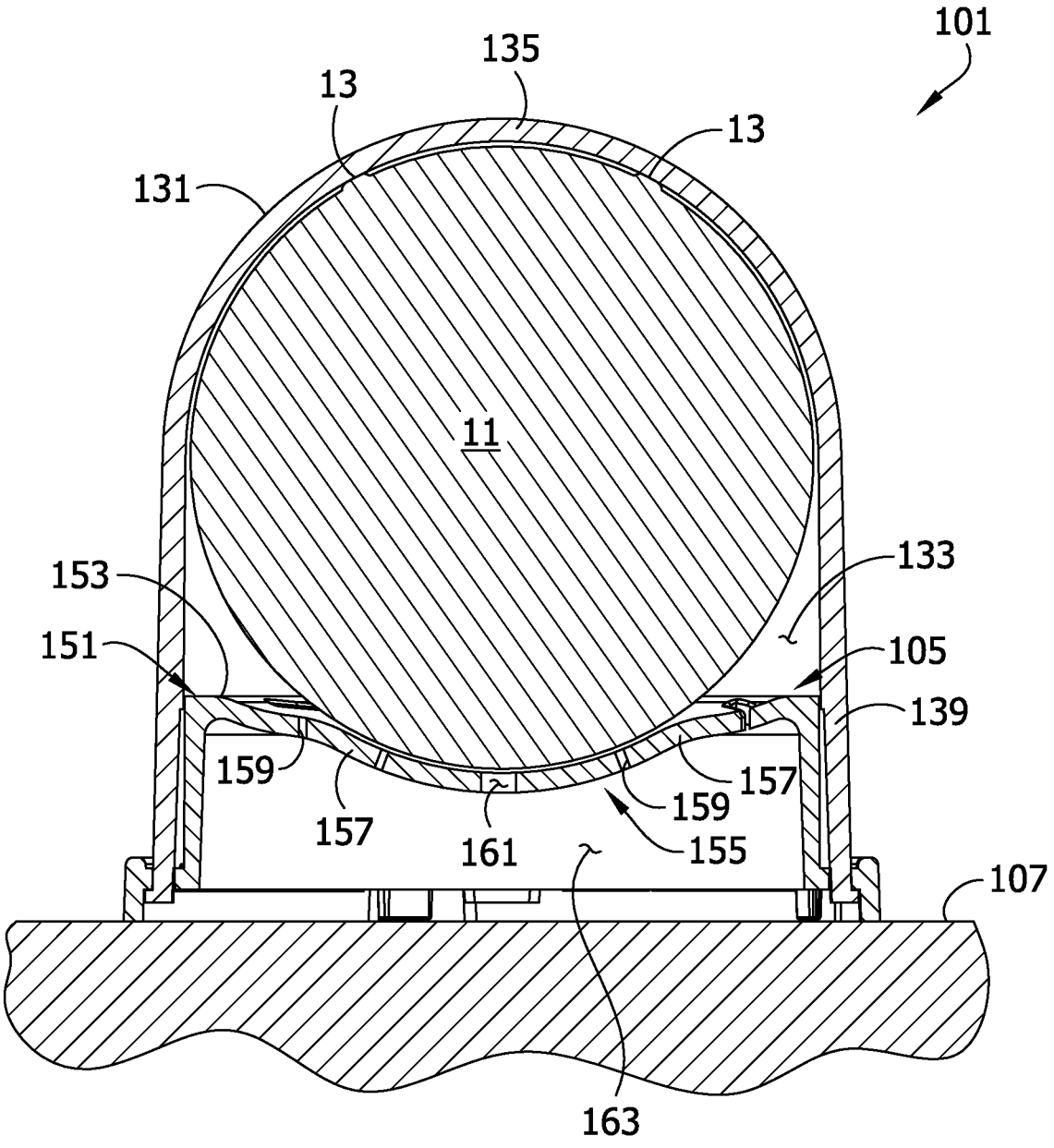
FIG. 3 is a cross section of the display case and baseball taken in a plane including line 3-3 in FIG. 1.
Figure 4:
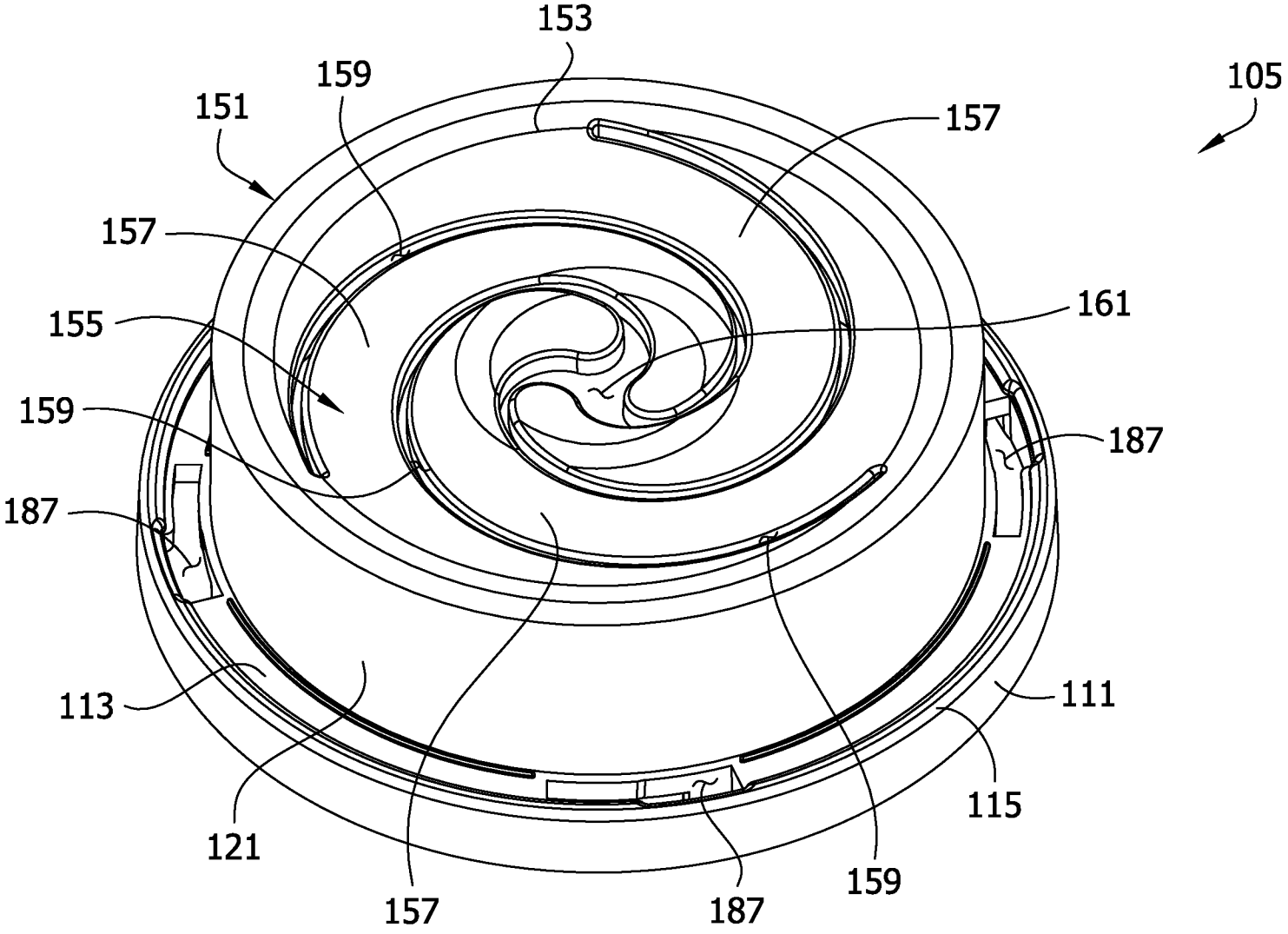
FIG. 4 is a top perspective of a base of the display case.
Figure 5:
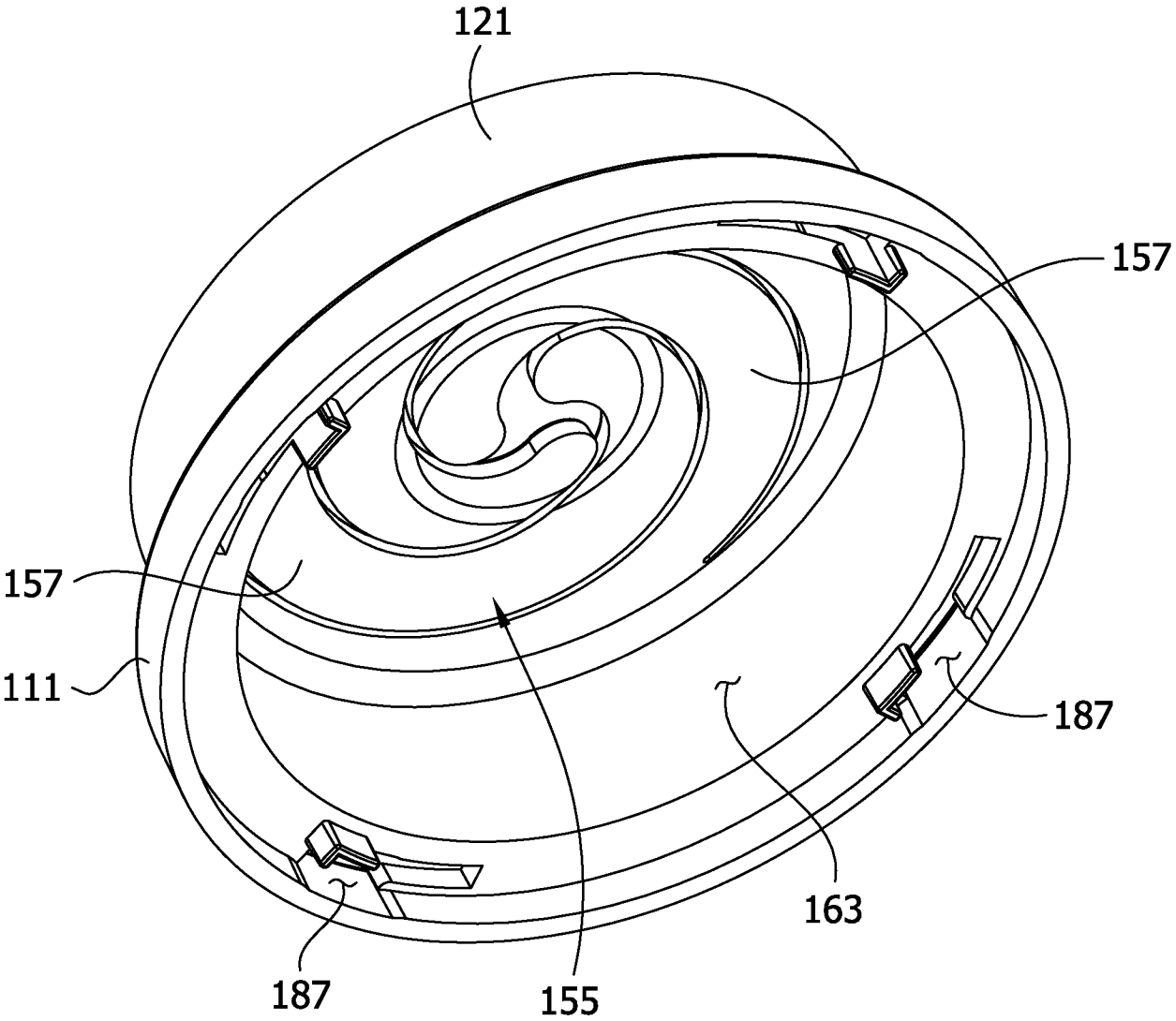
FIG. 5 is a bottom perspective of the base.

An exemplary embodiment of a display case of the present invention, generally designated 101, is illustrated in FIGS. 1-3 as a baseball display case, which is adapted to display a baseball 11. It is understood, however, that display cases of the present invention can display other kinds of sports memorabilia, including golf balls, softballs, basketballs, footballs, tennis balls, soccer balls, and the like.

Referring to FIGS. 1-7, the display case 101 comprises a base 105 for supporting the case on a surface 107 (e.g., a table, shelf, or the like), as shown in FIG. 3. In the illustrated embodiment, the base 105 is widest at its bottom. A lower sidewall 111 extends up from the bottom of the base 105. The lower sidewall 111 of the base is suitably generally cylindrical or frusto-conical with a slight (e.g., about 2 degrees) taper inward as it extends up from the bottom of the base. The base 105 also has a generally upwardly facing shoulder 113 (e.g., an annular shoulder) extending inward from the perimeter of the base at the top of the lower sidewall 111 (see FIGS. 2A, 3, 4, and 6). The top of the lower sidewall 111 suitably extends slightly above the shoulder 113 to form a retaining lip 115 extending around the perimeter of the shoulder. The base 105 also has an upper sidewall 121 extending generally upwardly from the inner margin of the shoulder 113. The upper sidewall 121 is suitably generally cylindrical or frusto-conical with a slight (e.g., about 2 degree) taper inward as it extends up from the shoulder 113.

Figure 6:
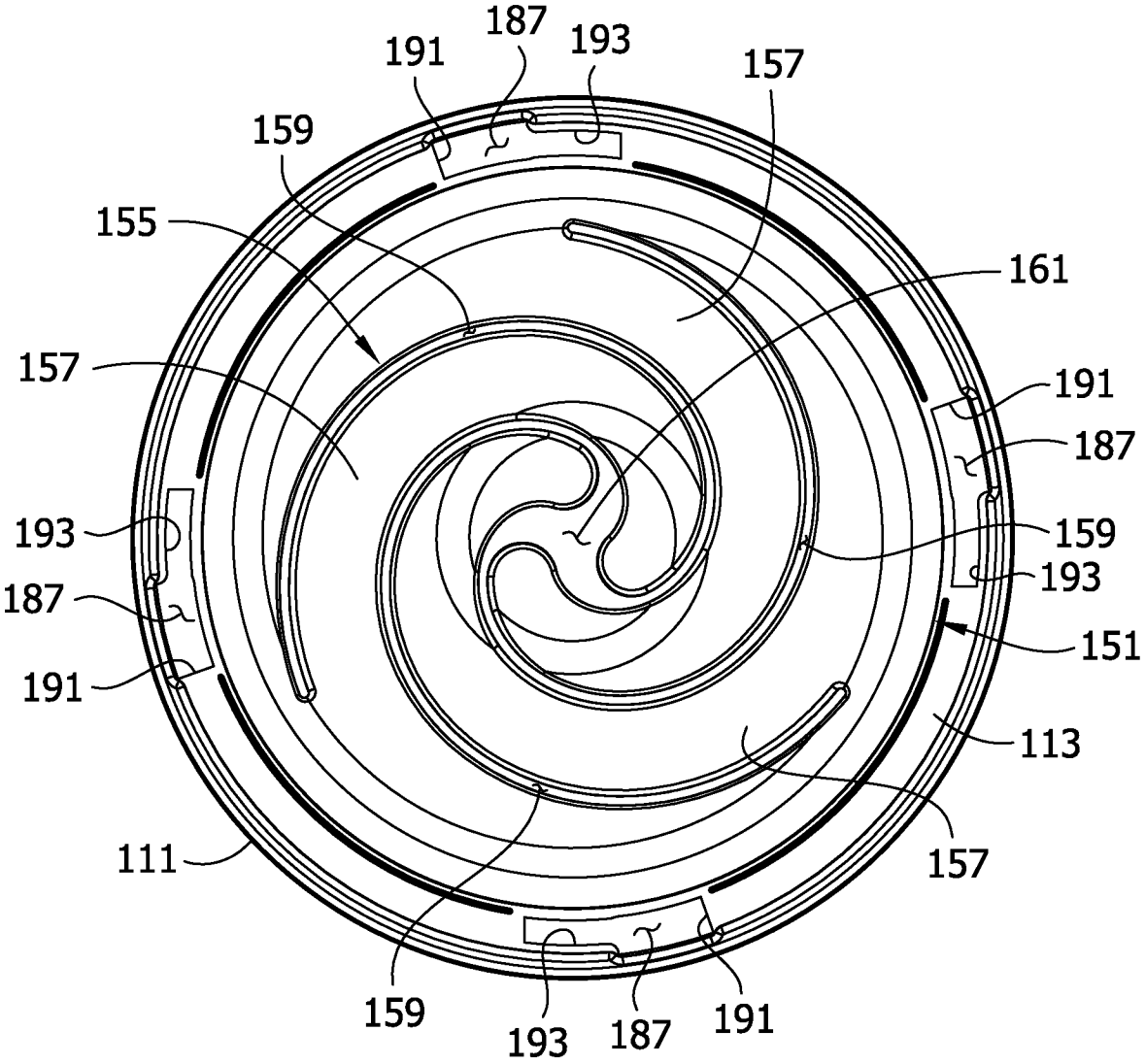
FIG. 6 is a top view of the base.
Figure 7:
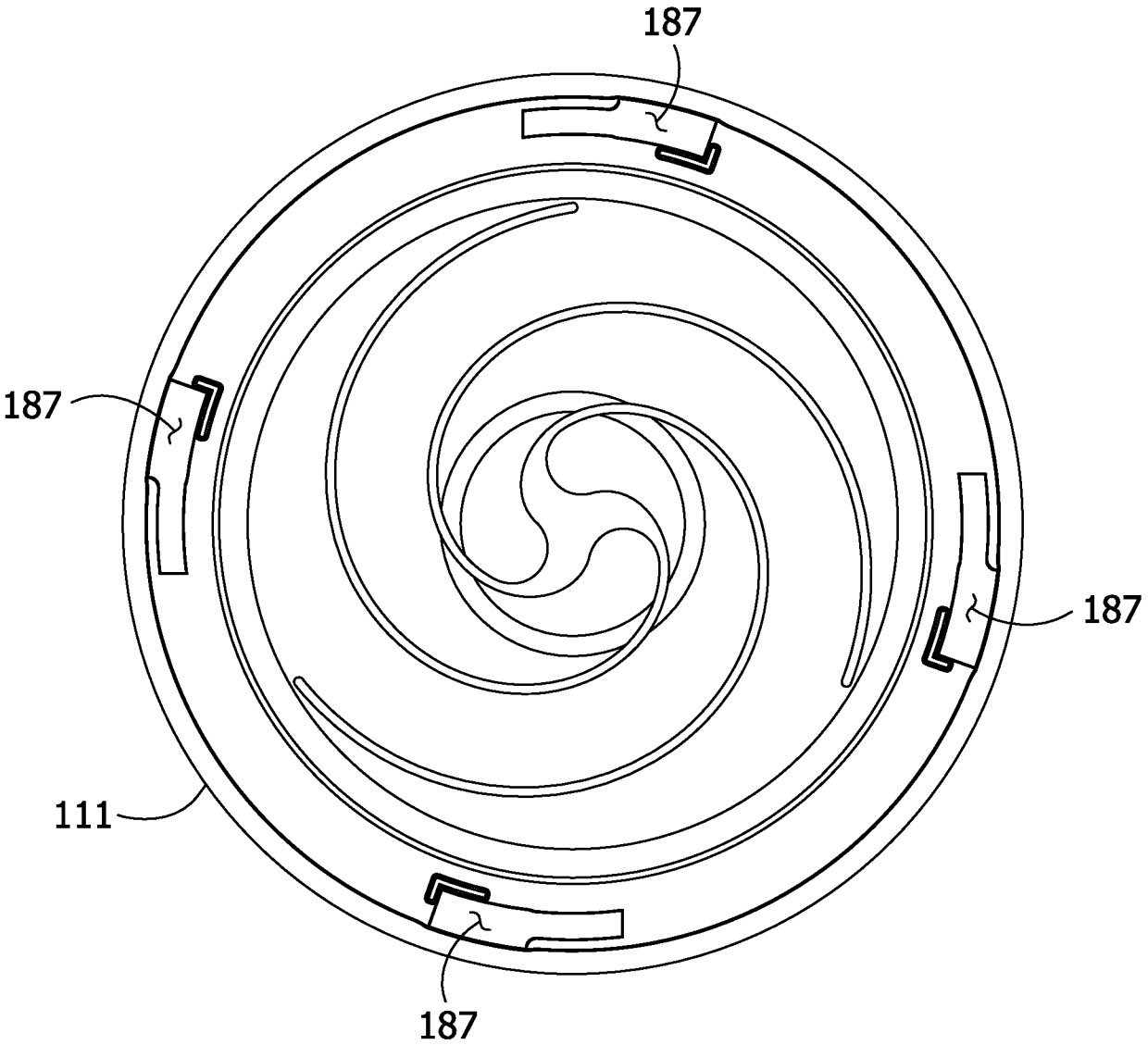
FIG. 7 is a bottom view of the base.
Figure 8:
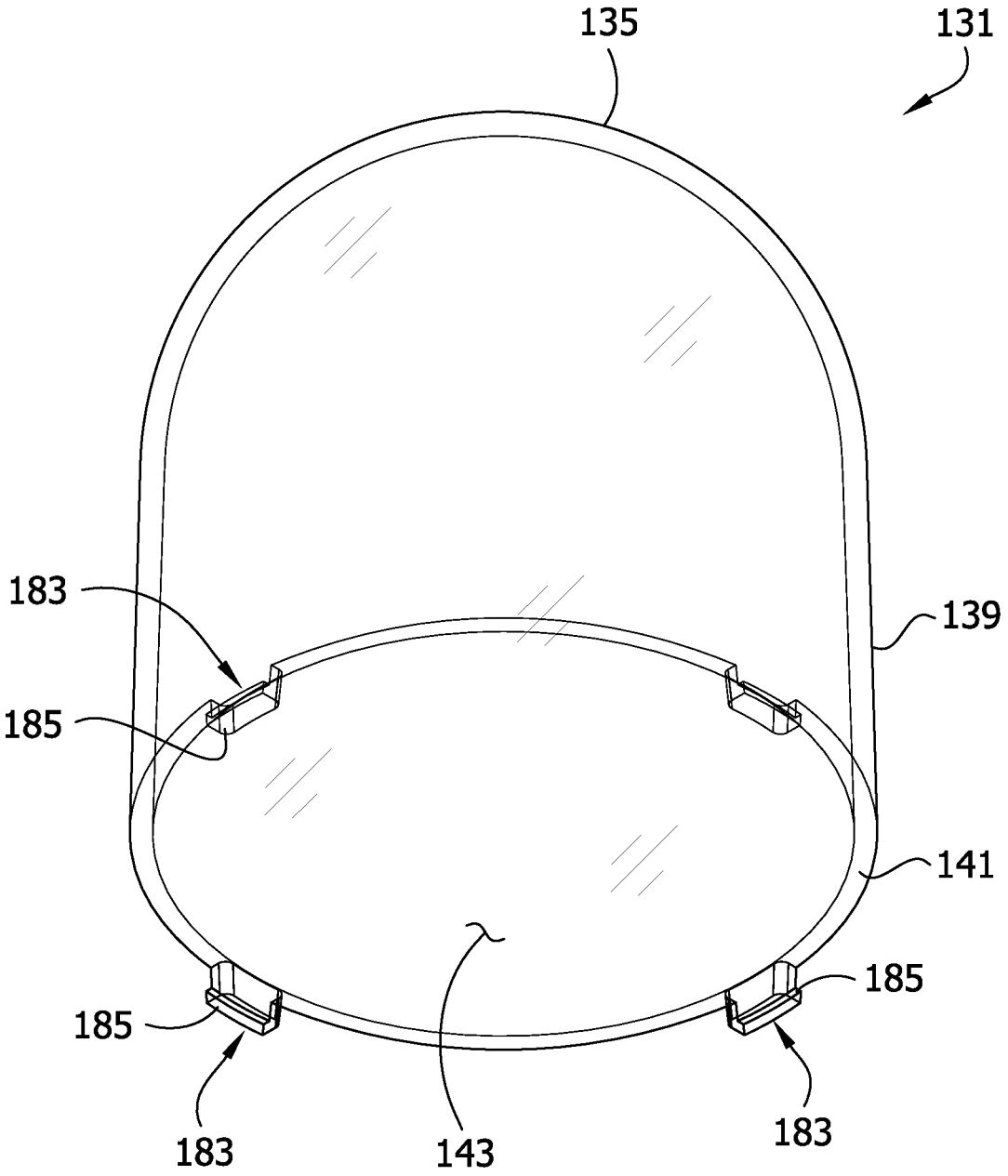
FIG. 8 is a top perspective of a cover of the display case.
Figure 9:
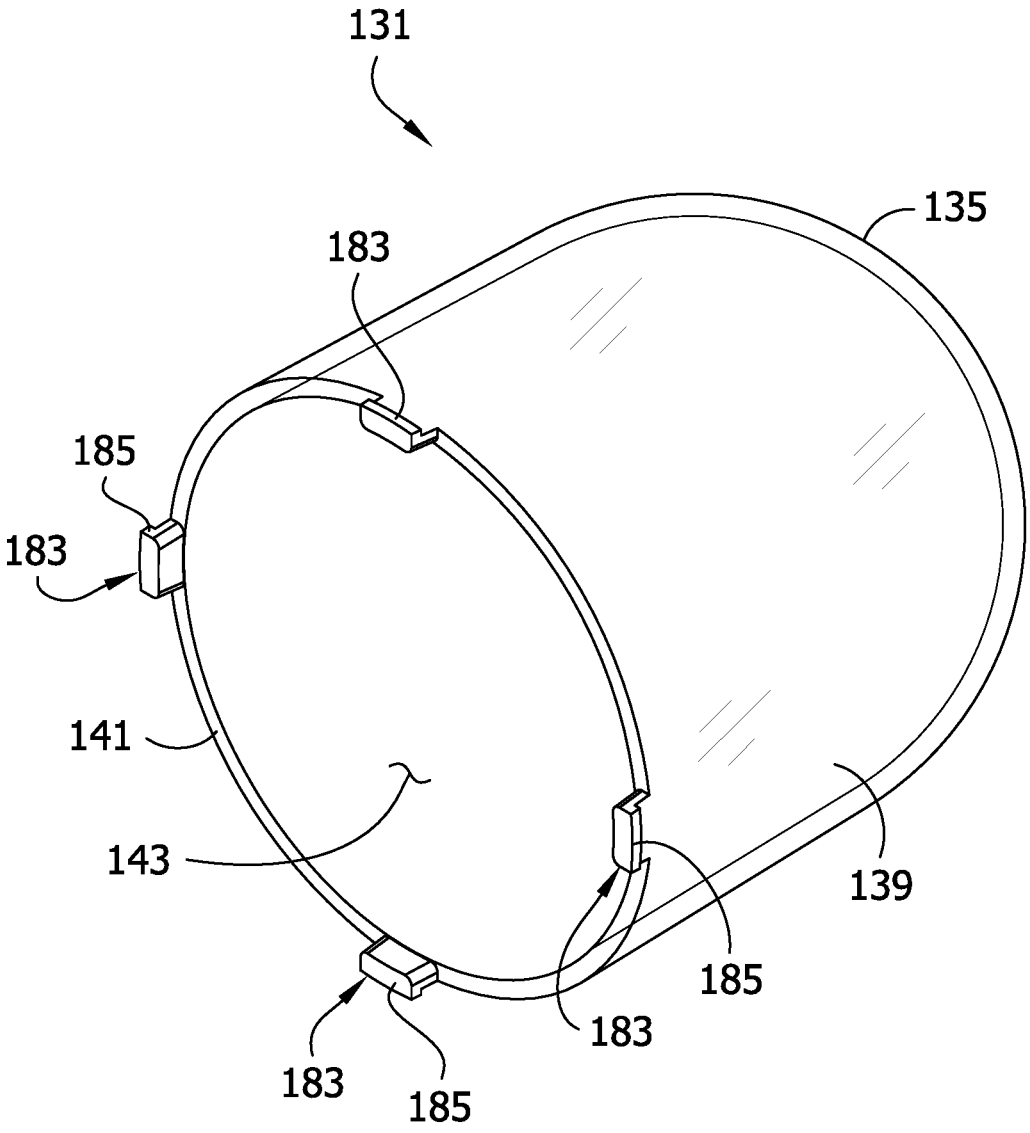
FIG. 9 is a bottom perspective of the cover.

The footprint of the upper sidewall 121 (i.e., the shape of the outline of the upper sidewall when viewed from the top as shown in FIG. 6) is suitably sized and shaped to be contained substantially within the inner margin of the shoulder 113. For example, in the illustrated embodiment, in which the sidewalls 111, 121 have substantially circular cross sections and in which the inner margin of the shoulder 113 is substantially circular, a largest diameter of the upper sidewall 121 is smaller than a smallest diameter of the lower sidewall 111. The largest diameter of the upper sidewall 121 is also no larger than a diameter of the inner margin of the annular shoulder 113.

The base 105 is suitably a unitary piece, as illustrated, and can be made of a relatively tough impact resistant material, such as Polycarbonate, ABS, or Acrylic, to limit the risk of accidentally breaking the base. A suitable base can be made using commercially available injection molding technology.

Referring again to FIGS. 1-3, 8 and 9, the display case 101 also includes a protective cover 131 that can be supported by the base 105. When the cover 131 is on the base 105, the cover and base at least partially enclose a space 133 (FIG. 3) sized and shaped for containing the ball 11. The cover 131 in the illustrated embodiment has a dome-shaped top 135 (e.g., a substantially hemispherical top) and a peripheral sidewall 139 (e.g., a substantially cylindrical or frusto-conical sidewall having a circular cross section) extending down from the top of the cover. The bottom edge 141 of the sidewall 139 defines an open end 143 of the cover 131 and is suitably sized and shaped to engage and be supported by the shoulder 113 of the base 105 when the cover is on the base. For example, in the illustrated embodiment in which the shoulder 113 has a circular shape, the lower edge 141 of the cover 131 has circular shape corresponding to the circular shape of the shoulder. The retaining lip 115 on the base 105 also extends around the lower end 141 of the sidewall 139 of the cover 131 when the cover is on the base.

The cover 131 (or at least a portion thereof) is suitably substantially transparent to visible light. This allows the ball 11 or other object in the display case 101 to be viewed through the cover 131 by someone outside the space 133. In the illustrated embodiment, the ball 11 is viewable through the sidewall 139 of the cover 131 from any direction (i.e., at any angle over a 360 degree range) because the entire sidewall is substantially transparent to visible light. The ball 11 is also viewable through the top 135 of the cover 131 in the illustrated embodiment because the top is also substantially transparent to visible light.

The cover 131 is suitably relatively less transparent to ultraviolet and/or infrared light than it is to visible light. For example, the cover 131 suitably blocks from at least about 70 percent to about 99.9% of UVA radiation (wavelengths in the range of 320 nm to 400 nm). One example of a suitable material that provides UV protection is Acrylite® 8N which is commercially available from Evonik CYRO LLC of Parsippany, N.J. One or more additives can suitably added to the material used to make the cover 131 to protect the ball 11 from infrared radiation. Suitable materials including additives that provide infrared protection are commercially available from Evonik CYRO LLC of Parsippany, N.J. Protecting the ball 11 from exposure to ultraviolet and/or infrared radiation in this manner can reduce degradation of the ball 11 that could be caused by these types of radiation.

The cover 131 is suitably made from a relatively tough impact resistant material to limit the risk of accidentally breaking the cover. Although the cover 131 can be made from various different materials within the scope of the invention, some materials that are suitable for the cover include Acrylic and Polycarbonate. A suitable cover can be molded as a unitary structure using commercially available injection molding processes.

As best understood in reference to FIGS. 3-7, a pedestal 151 is integrally formed with the base 105 and has a surface 153 disposed to support the ball 11 in the display case 101. In the illustrated embodiment, a spring 155 at least partially defines the support surface 153 of the pedestal 151 and is shaped and configured so a portion of the support surface generally deforms and conforms to the shape of the ball 11 to seat the ball in the display case 101. The spring 155 comprises a circular platform formed by a plurality of spiral spring members 157. In the illustrated embodiment, there are three spring members 157. However, other numbers of spring members 157 are envisioned without departing from the scope of the invention. The spring members 157 extend from an outer edge margin of the platform generally to a center of the platform. Each spring member 157 has a wide base portion, and an elongate spiral portion extending from the base portion and which terminates at a narrow free end of the spring member. In the illustrated embodiment, the free ends of the spring members 157 are rounded. However, the free ends of the spring members 157 can have other shapes without departing from the scope of the disclosure.

The spring members 157 are circumferentially spaced around the pedestal 151. The spacing between the spring members 157 defines spiral gaps 159 between the spring members. The spiral gaps 159 extend from the outer edge margin of the platform to the center of the platform where they converge at a center opening 161 in the platform. The spring members 157 are configured to deflect downward when engaged by the ball 11 and apply an upward spring force to the ball to press the ball against an underside of the top 135 of the cover 131. The spring members 157 also apply inward spring forces to the ball 11 to center the ball within the interior space 133 of the display case 101. The downward movement of the spring members 157 at least partially closes the spiral gaps 159 and widens the center opening 161. The bias of the spring 155 to return to its natural state causes the upward and inward spring forces on the ball 11. It is envisioned that other spring configurations can be used without departing from the scope of the disclosure.

Generally, the spring 155 facilitates positioning the ball 11 on the pedestal 151. For example, the spring 155 centers the ball 11 on the pedestal 151 and also makes it less likely that the ball will accidentally fall off the pedestal (e.g., before the cover 131 is secured to the base 105). Further, the spring 155 facilitates distribution of the forces supporting the ball 11 over a wider area of the ball. This can help preserve the condition of the ball 11. Additionally, as will be explained in greater detail below, the spring 155 is automatically and dynamically responsive to different sizes and shapes of balls and to changing conditions of a ball to hold the ball in the proper position within the display case 101.

In the illustrated embodiment, the base 105 has a hollow center 163 (FIGS. 2A and 3). In this embodiment, the pedestal 151 of the base 105 extends over the top end of the base and operates in conjunction with the cover 131 to enclose the ball 111 in the display case 101. The pedestal 151 in the illustrated embodiment is a unitary structure with the base 105. It is understood, however, that a pedestal may be constructed as a separate structure from the base within the scope of the invention. In this embodiment, the pedestal may be seated on top of the base. A suitable pedestal can be made of Polycarbonate, ABS, Acrylic or the like using commercially available injection molding technology. Further, the same materials describe above that can be used to make the cover 131 so it protects against ultraviolet and/or infrared radiation can be used to make a substantially transparent pedestal that protects against ultraviolet and/or infrared radiation. Broadly, the base 105 and pedestal 151 may be considered a base assembly.

In the illustrated embodiment, the effective height of the pedestal 151 (particularly the support surface 153 thereof) relative to the base 105 automatically changes to accommodate the size/shape of the ball 11 in the display case 101. Balls (even when they are the same type) can vary slightly in size. For example, a ball may shrink slightly over an extended period of time as gases are slowly released from the ball. If the ball 11 to be displayed in the case 101 is slightly smaller than a "normal" ball, such as might be the case with an older ball, or has gotten smaller within the case over time, the effective height of the pedestal 151 (and therefore the elevation of the ball) is suitably raised by the spring force of the spring 155 so the ball extends up from the pedestal to contact the underside of the top 135 of the cover 131, which is suitably shaped to conform to the shape of the ball. In particular, the spring force is configured so the ball 11 is very lightly compressed between the cover 131 and the pedestal to inhibit shifting or rattling of the ball in the case 101. If the ball 11 is too large, the effective height of the pedestal 151 is lowered by virtue of the downward deflection of the spring members 157 to reduce compression of the ball between the cover 131 and the pedestal.

Additionally, if the ball is non-symmetrical, oblong, or otherwise abnormally shaped, the spring 155 is configured to generally conform to the shape of the ball and apply the appropriate spring forces across the surface of the ball to properly position the ball in the display case 101. In this instance, the spring forces may be unevenly distributed across the ball in order to properly position the ball in the display case 101. Thus, the base 105 and pedestal 151 do not have to be individually selected for a given ball otherwise sized and shaped to fit within the display case 101.

Because the spring 155 of the pedestal 151 and the inner surface of the cover 131 at the top 135 are both shaped to generally conform to the outer surface of the ball 11, the light compressive forces are suitably distributed over a large area of the ball. In the case of a baseball 11, for example, the pedestal 151 and cover 131 contact relatively broad areas of the ball at the raised seams 13 instead of subjecting the ball to concentrated forces at only a few different points. Light compression of the ball 11 between the cover 131 and pedestal 151 limits the ability of the ball 11 to rattle in the space 133 between pedestal and cover. This can help preserve the condition of the ball. The light compression also limits the ability of the ball to rotate in the case 101 and makes it more likely that the ball will be maintained in a desired orientation, such as one in which an autograph or other feature of interest is displayed prominently.

Figure 10A:
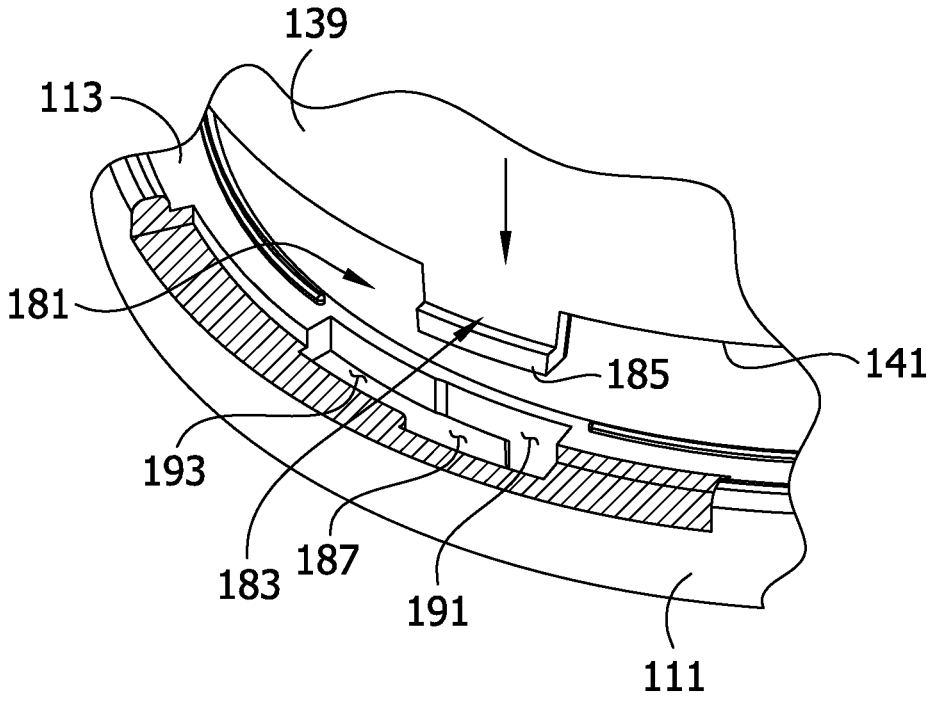
FIGS. 10A and 10B are enlarged fragmentary perspectives of the ball display case illustrating operation of a bayonet connection to secure the cover to the base of the display case.
Figure 10B:
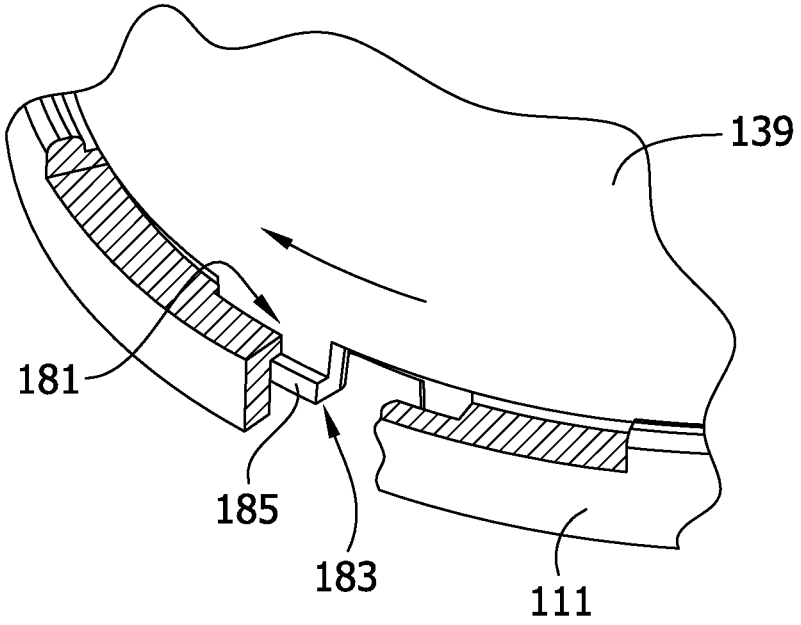
Figure 11:
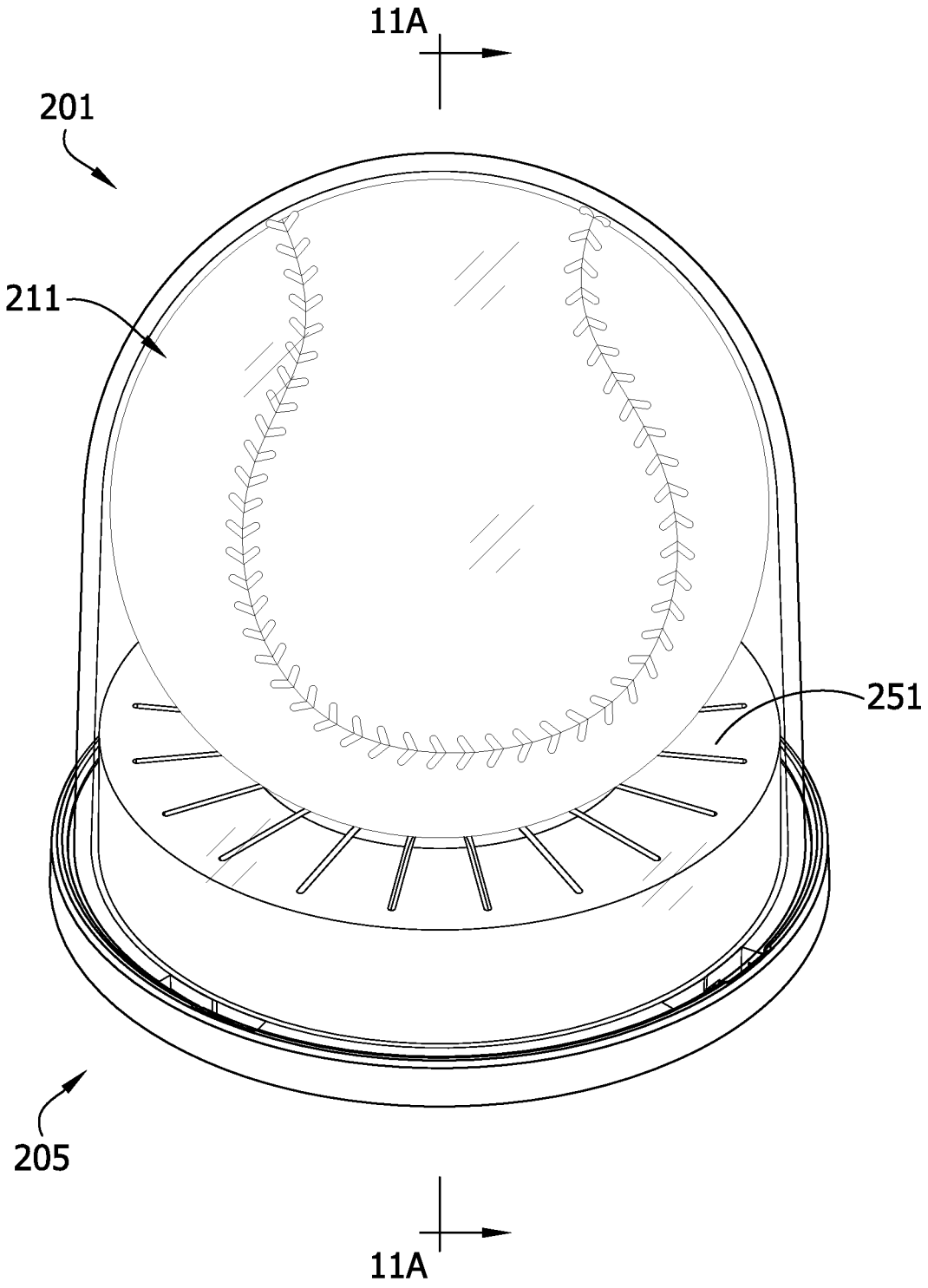
FIG. 11 is a perspective of an exemplary embodiment of another embodiment of a ball display case displaying a softball.
Figure 11A:
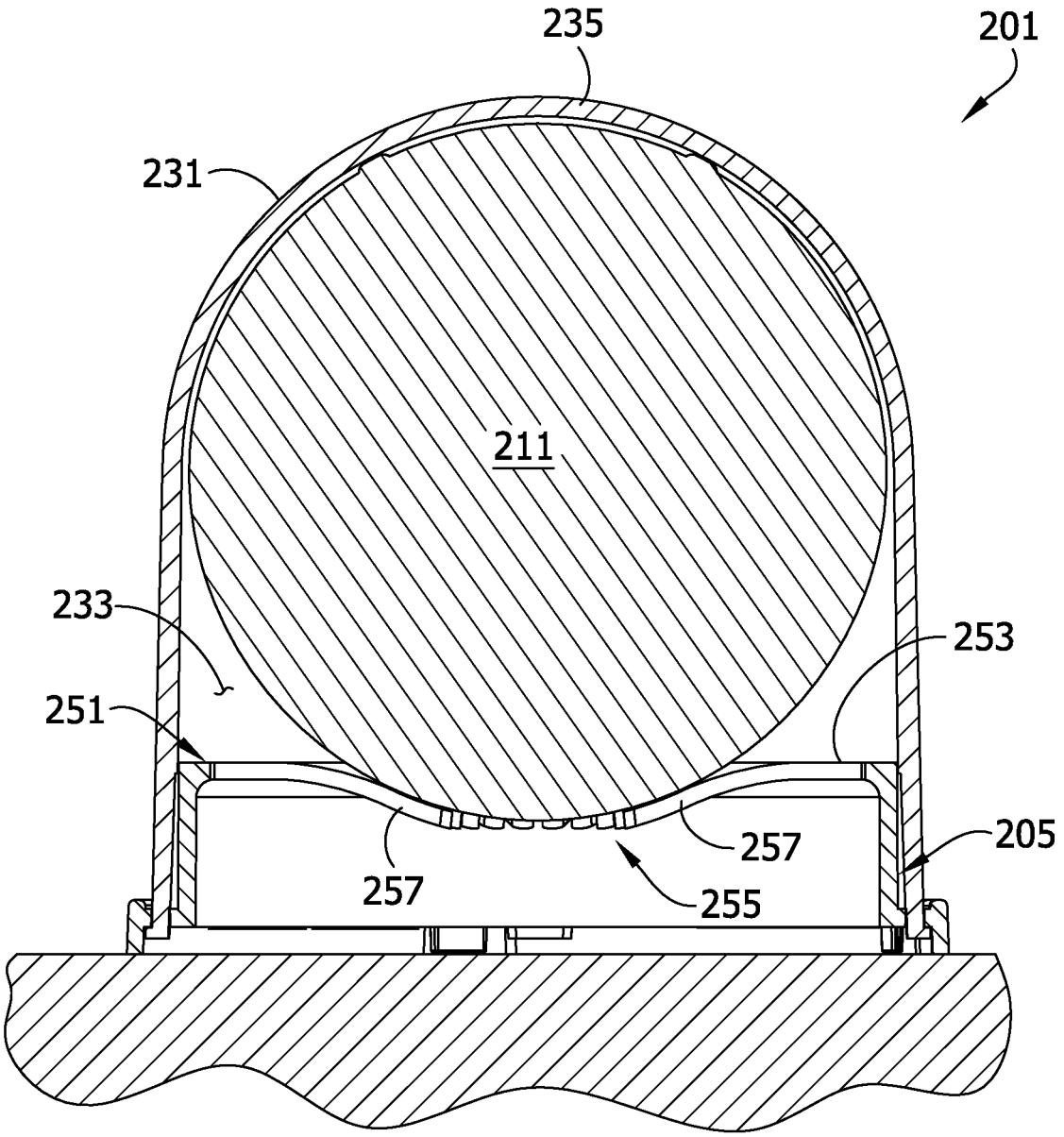
FIG. 11A is a cross section of the display case and softball taken in a plane including line 11A-11A in FIG. 11.
Figure 12:
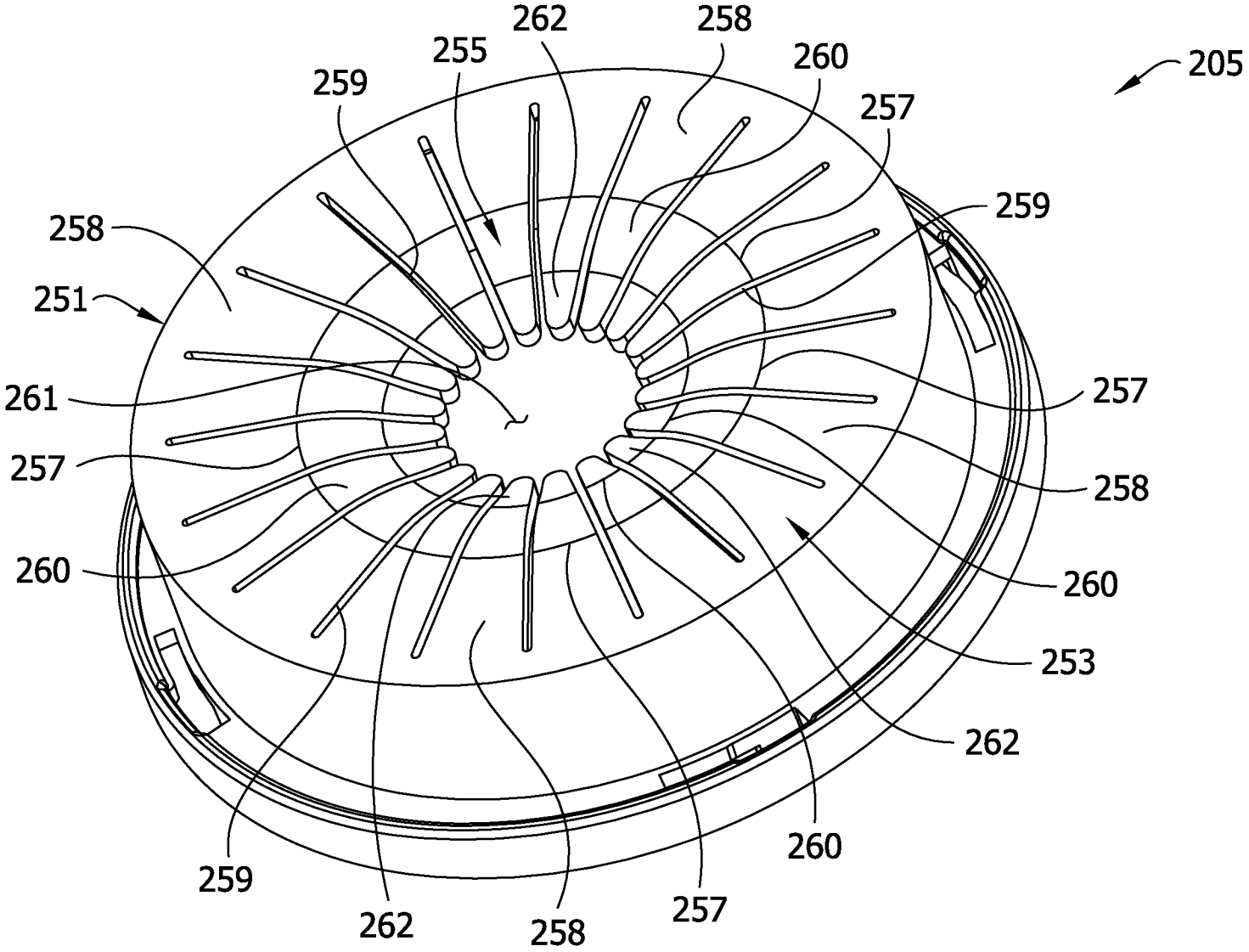
FIG. 12 is a top perspective of a base of the display case in FIG. 11.
Figure 13:
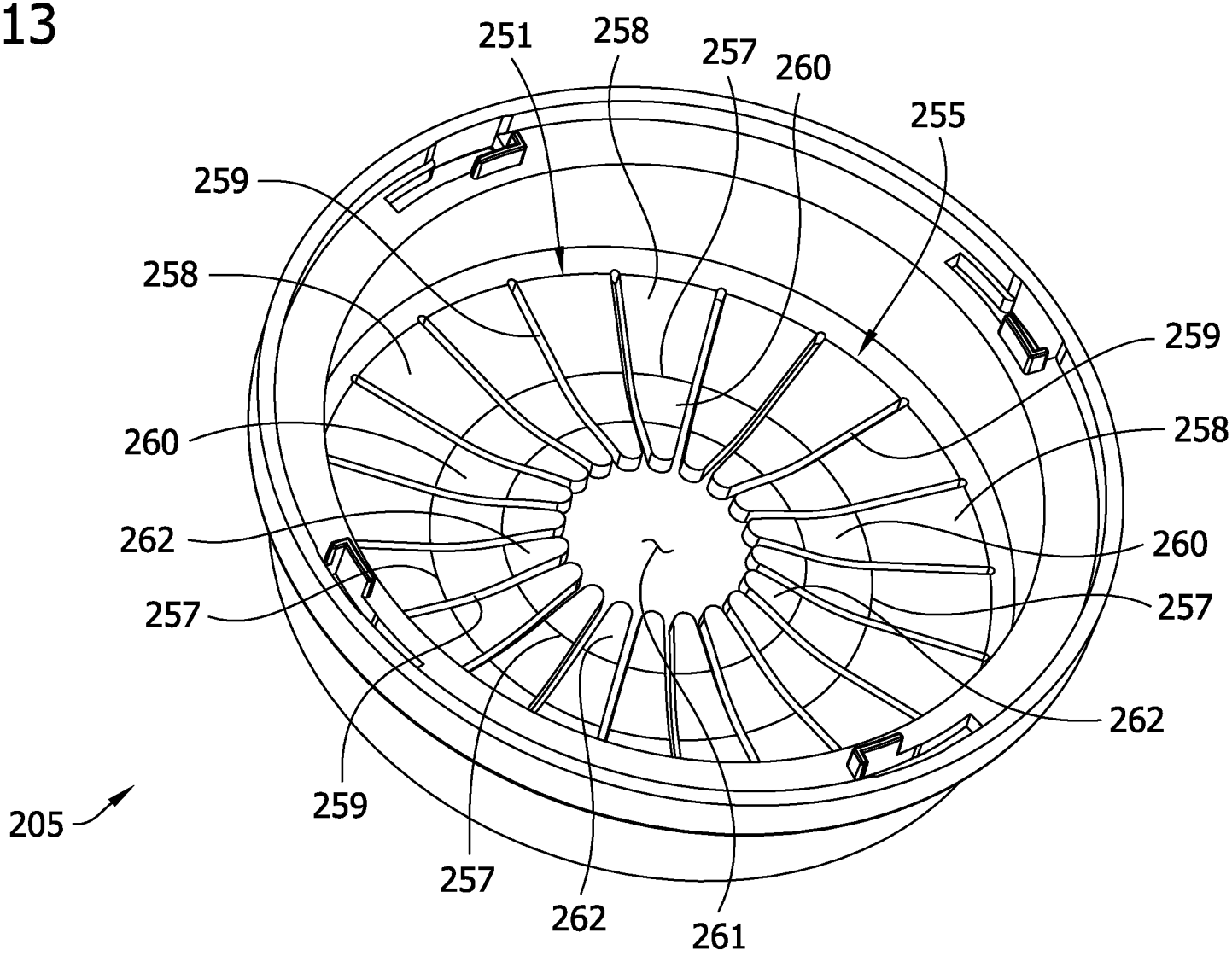
FIG. 13 is a bottom perspective of the base in FIG. 12.
Figure 14:
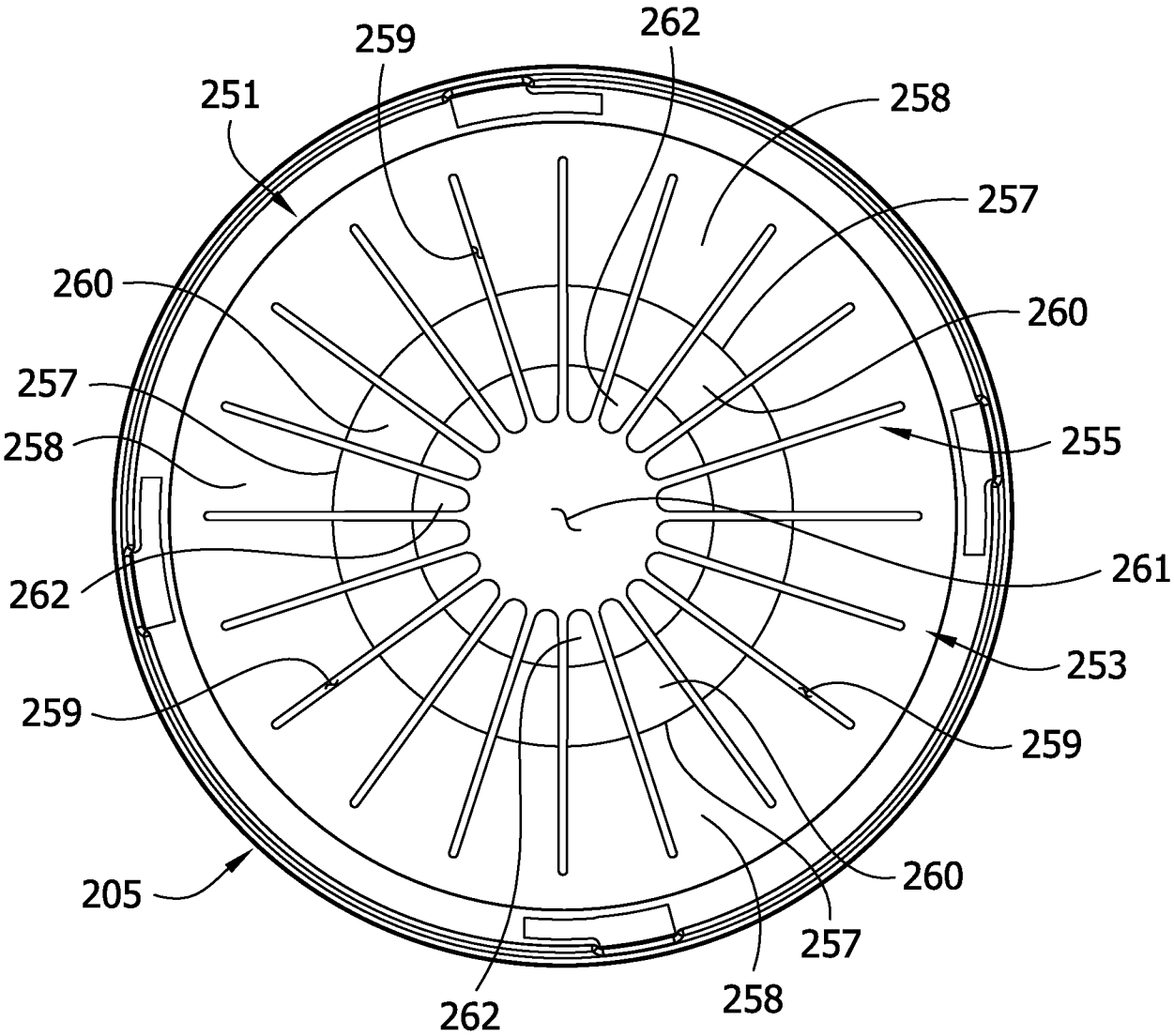
FIG. 14 is a top view of the base in FIG. 12.
Figure 15:
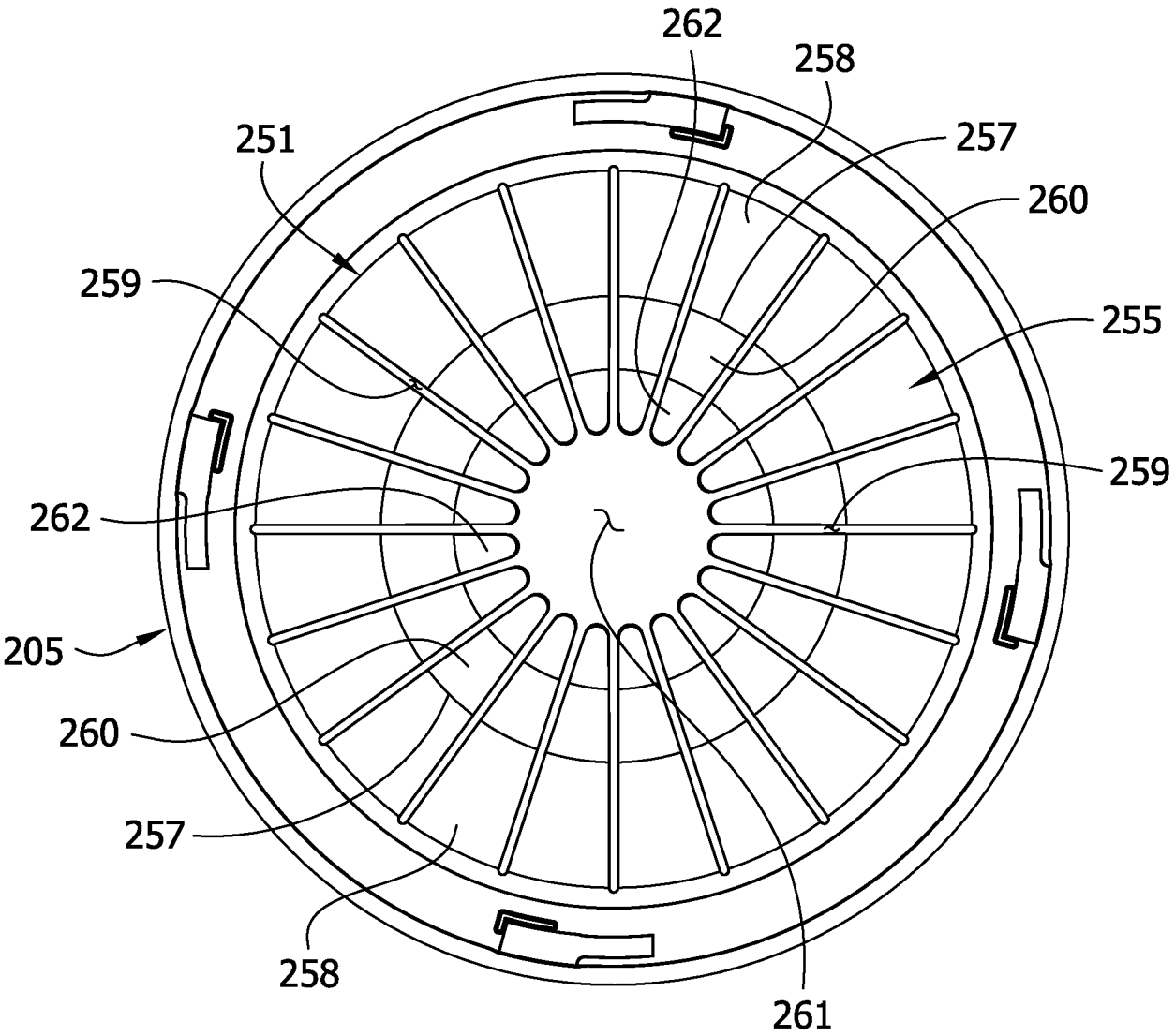
FIG. 15 is a bottom view of the base in FIG. 12.
Figure 16:
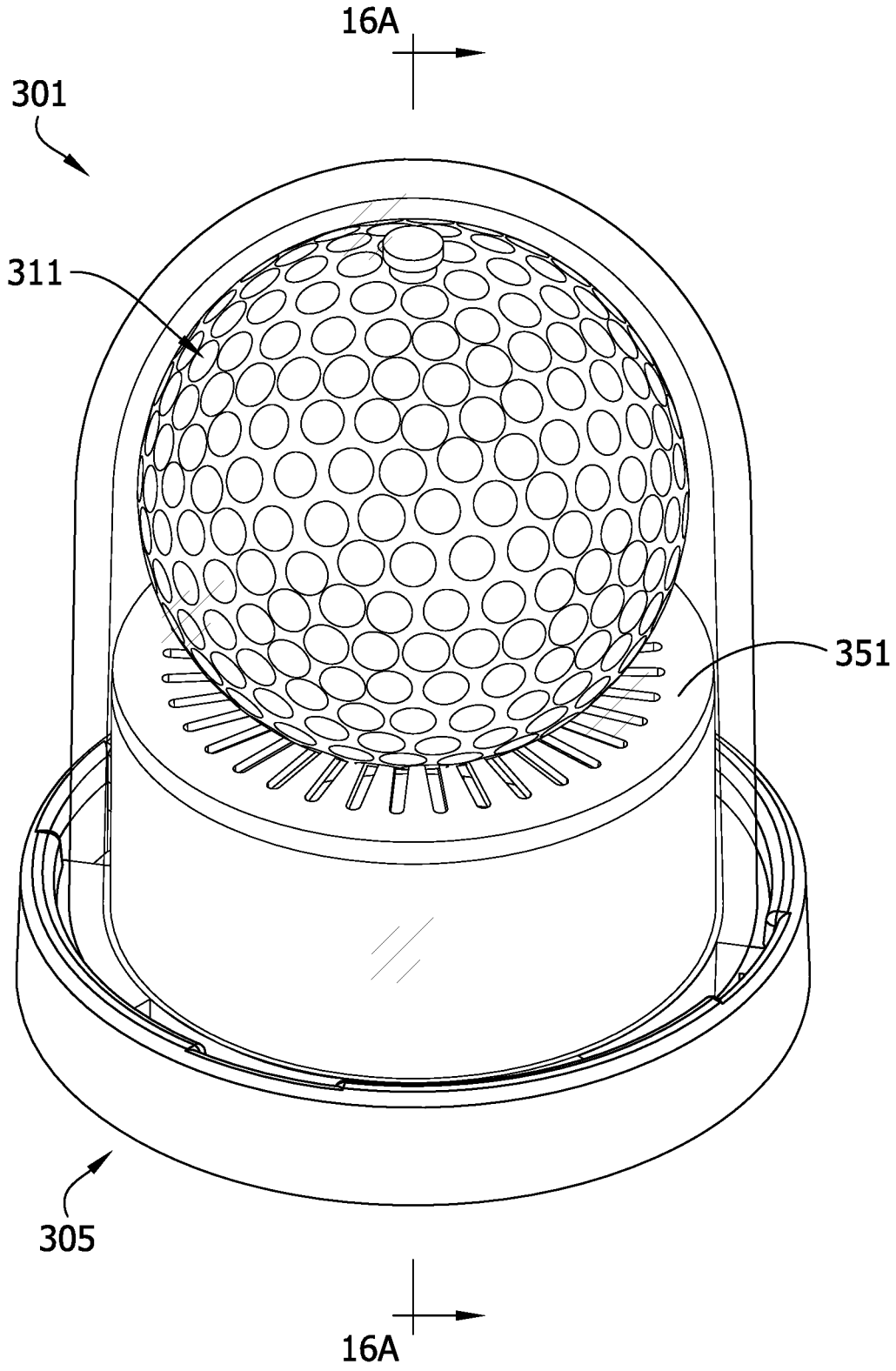
FIG. 16 is a perspective of an exemplary embodiment of another embodiment of a ball display case displaying a golf ball.
Figure 16A:
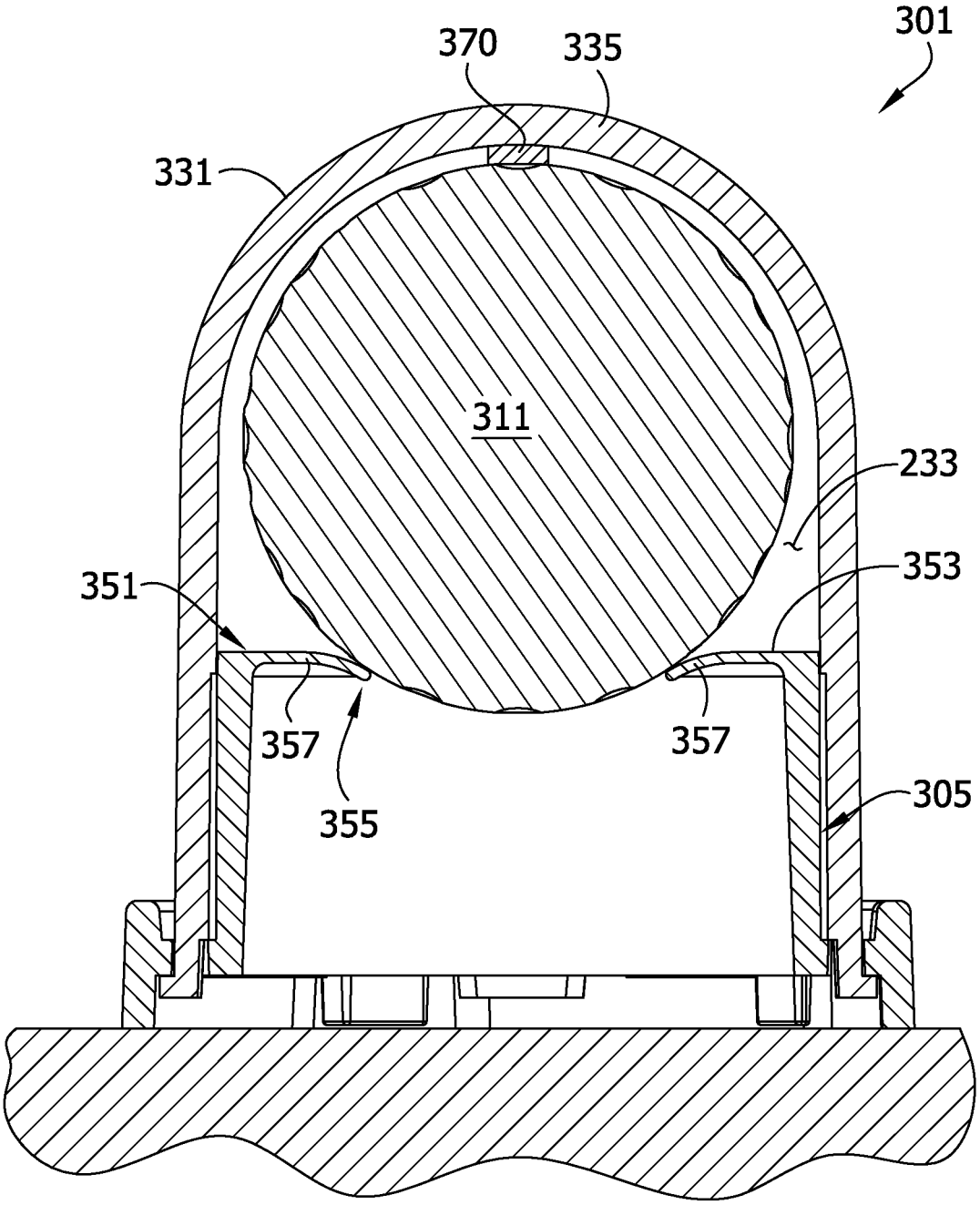
FIG. 16A is a cross section of the display case and softball taken in a plane including line 16A-16A in FIG. 16.
Figure 17:
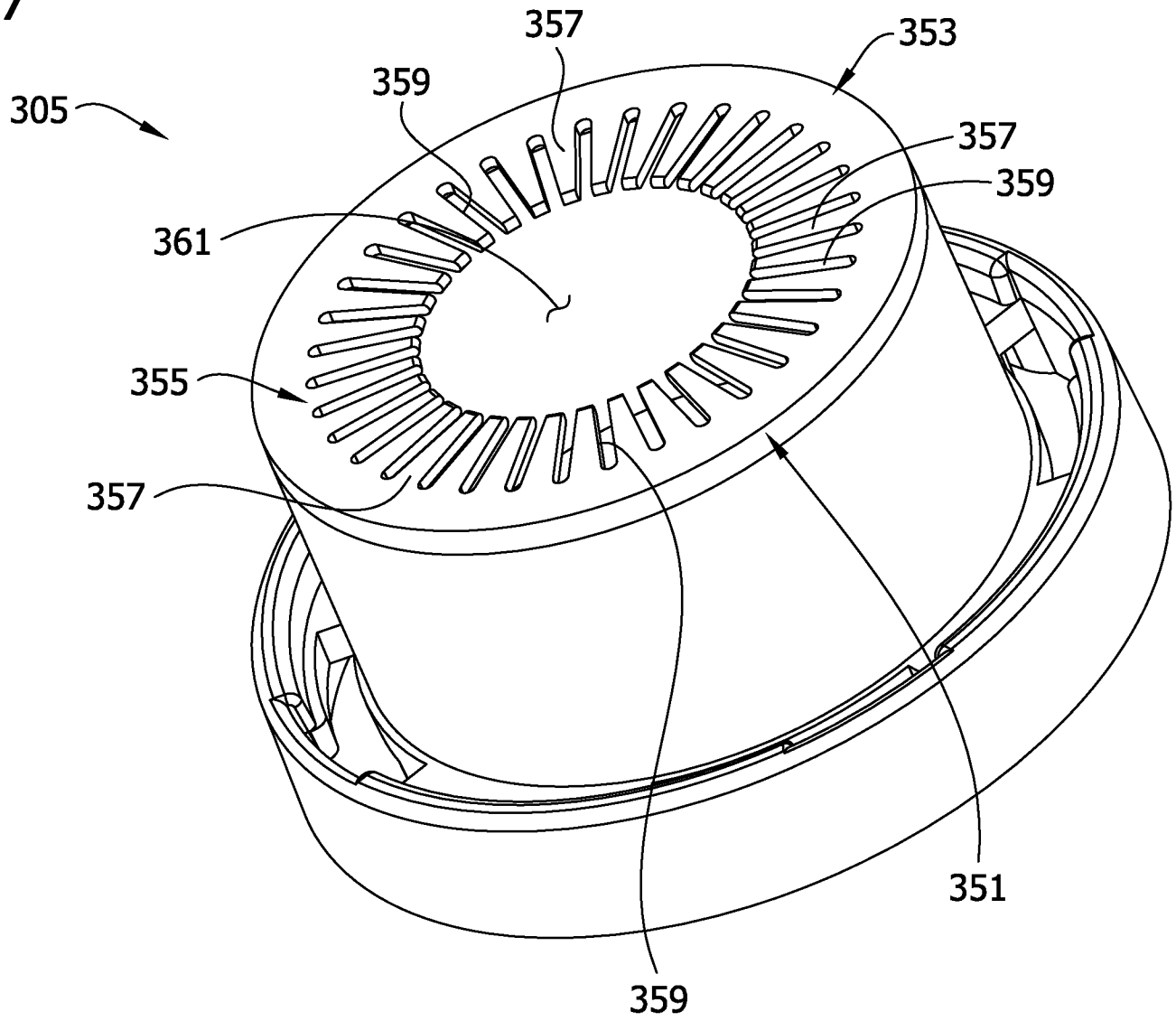
FIG. 17 is a top perspective of a base of the display case in FIG. 16.
Figure 18:
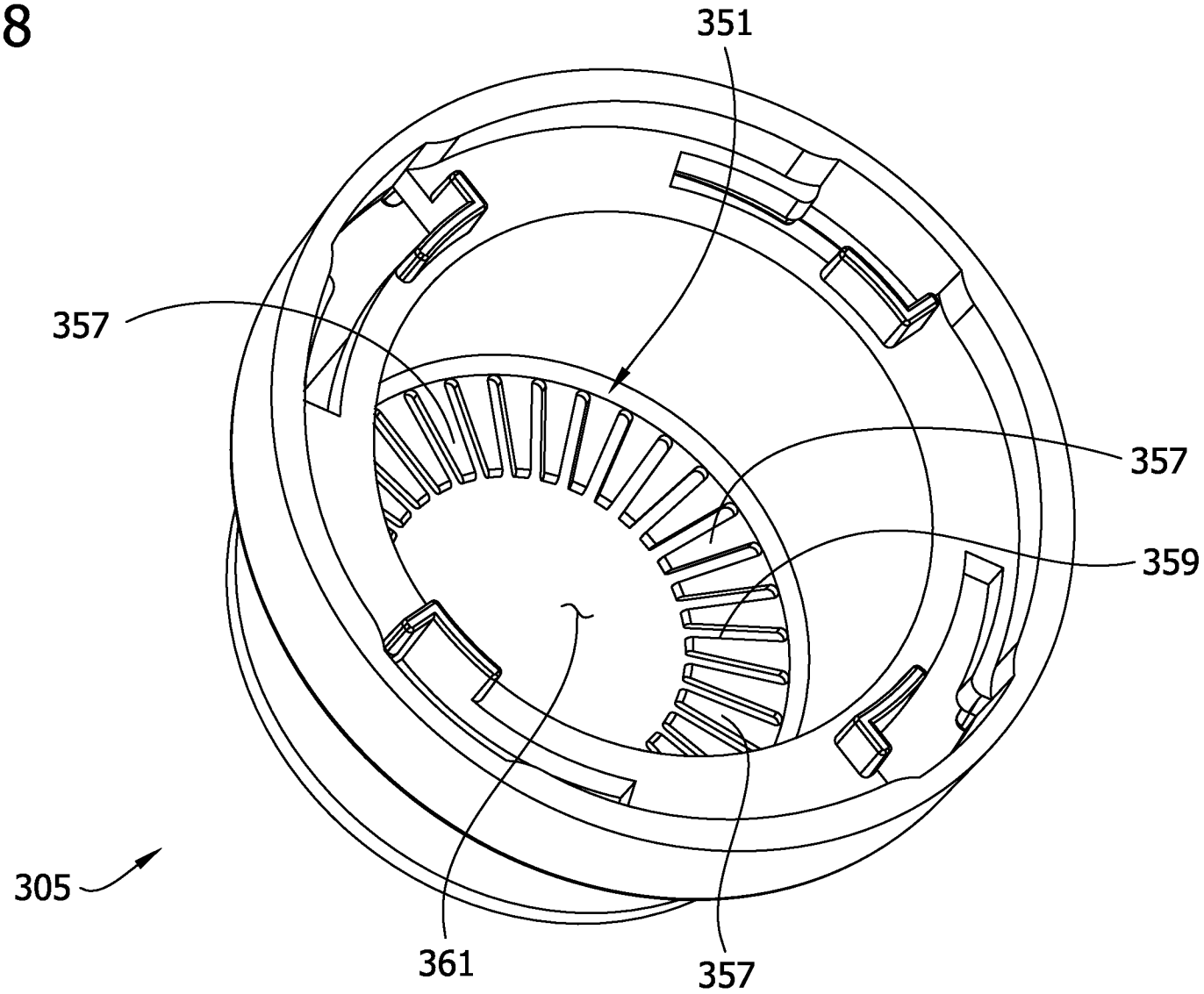
FIG. 18 is a bottom perspective of the base in FIG. 16.
Figure 19:
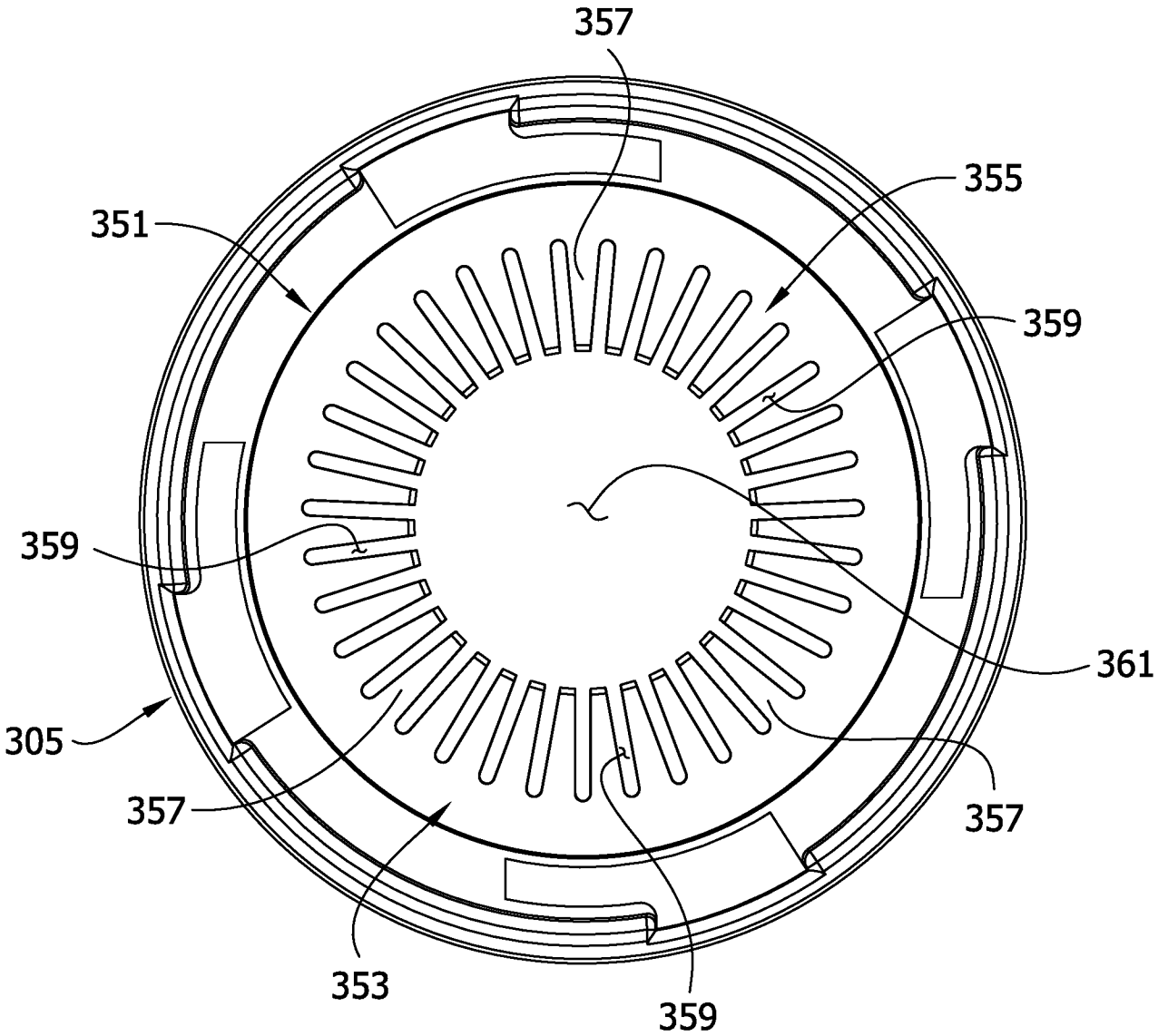
FIG. 19 is a top view of the base in FIG. 16.
Figure 20:
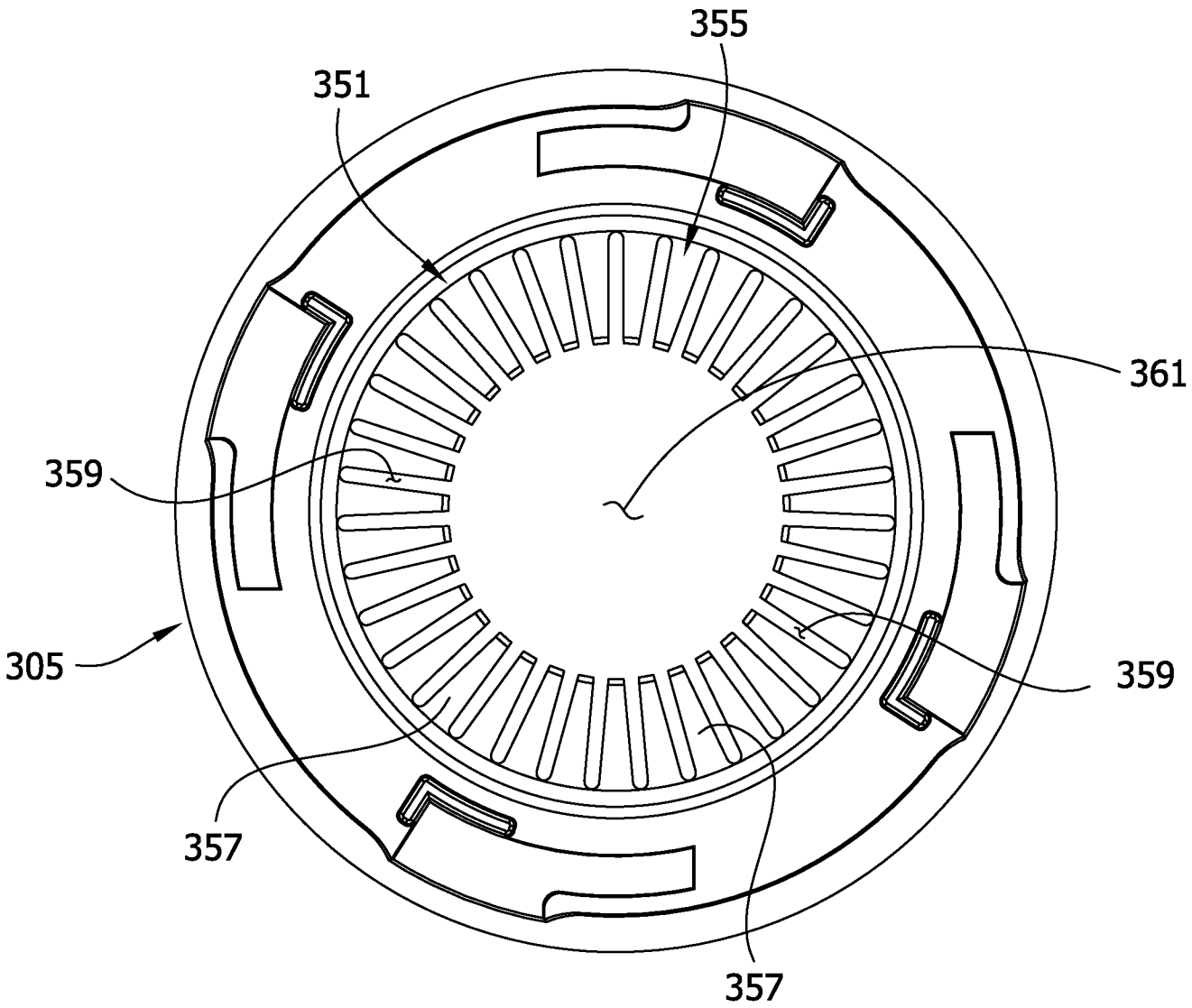
FIG. 20 is a bottom view of the base in FIG. 16.

The cover 131 is suitably securable to the base 105 (e.g., to the shoulder 113) to hold the cover on the base. For example, a bayonet connection 181 can suitably be used to secure the cover 131 to the base 105. As best illustrated in FIGS. 10A and 10B, a plurality of lugs 183 (e.g., four lugs) extend down from the lower end 141 of the cover's sidewall 139. Each lug 183 has a laterally extending projection 185 (which is a radially extending flange in the illustrated embodiment) spaced from the bottom edge 141 of the cover sidewall 139. A plurality of openings 187 (e.g., arcuate slots) in the shoulder 113 are arranged to receive the lugs 183. Each opening 187 has a relatively wider portion 191 and a relatively narrower portion 193 adjacent the wider portion.

The wider portions 191 of the openings 187 provide sufficient clearance for each of the lugs 183 to be inserted into a respective one of the openings when the cover 131 is moved into engagement with the base 105, as illustrated in FIGS. 10A and 10B. The cover 131 is moveable (e.g., rotatable) relative to the base 105 such that after the lugs 183 have been inserted into the relatively wider portions 191 of the openings 187, the cover can be moved relative to the base 105 to move the lugs into the narrower portions 193 of the openings. As the lugs 183 move into the relatively narrower portions 193 of the openings 187, the projections 185 are captured within the openings 187.

There is insufficient clearance in the relatively narrower portions 193 of the openings 187 for the lugs 183 to be withdrawn from the openings through the narrower portions. In the illustrated embodiment, for example, when the cover 131 is secured to the base 105 by the bayonet connection 181 and a lifting force is applied to the cover, the radially extending flanges 185 engage a downward facing surfaces of the base 105 which thereby retain the lugs 183 in the openings. Accordingly, when the lugs 183 are in the narrower portions 193 of the openings 187, the cover 131 is retained in position relative to the base 105. In order to remove the cover 131 from the base 105 once it has been secured in this manner without destroying the lugs 183 and/or the edge margins of the openings 187, the cover has to be rotated relative to the base to move the lugs back into the relatively wider portions 191 of the openings before lifting the cover off the base.

When the cover 131 is on the base 105, it suitably limits access to the ball 11 (when there is a ball in the display case 101). As illustrated in FIGS. 1-3, for example, the cover 131 suitably extends substantially continuously around all sides and over the top of the ball 11 (or the space 133 for containing the ball if the display is empty). Further, when the ball 11 is in the space 133 between the base 105 and the cover 131, the pedestal 151 of the base 105 limits access to the ball through the open end 143 of the cover. The space 133 for containing the ball 11 is suitably not hermetically sealed to allow venting (e.g., to allow escape of any gases released from the ball) and to make the display case 101 less susceptible to formation of condensation in the space that holds the ball 11. However, the ball 11 is well protected from physical damage and cannot be removed from the space 133 without taking the cover 131 off the base 105.

In some cases, there is a relatively low risk of theft or fraud involving the ball 11 and additional security precautions may be unnecessary. In these cases, the display case 101 can be maintained indefinitely in a condition in which the cover 131 is releasably secured to the base 105 so the ball 11 can be taken out of the display case and replaced in the display case. However, in other cases it may be desirable to limit the ability to remove of the ball 11 from the display case 101 once it is enclosed therein in order to combat theft and/or fraud. In this instance, a lock (not shown) may be fitted to a bottom of the base 105 to prevent motion of the cover 131 relative to the base in a manner required to release the connection between the cover and the base.

The base 105 and cover 131 can be treated to have a protective coating or glazing on exterior surfaces of their bodies. Various coatings or glazings can be applied to provide scratch resistance, reduce glare, control static, and/or to provide protection against ultraviolet and/or infrared radiation. For example, a Magnetron Sputtered thin film multi-layered anti-reflective coating (e.g., Optium Museum Acrylic® coating, commercially available from Tru Vue, Inc. of McCook, Ill.) can suitably be applied to one or both sides of each part of the display case 101. The Optium Museum Acrylic® coating is an abrasion resistant, anti-reflective coating that transmits about 96% of visible light and blocks about 98 percent of ultraviolet light. Further, non-yellowing agents can be added to the materials used for the cover 131 and base 105 to limit discoloration over time.

The cover 131 limits access to the upper sidewall 121 of the base 105 when the cover is on the base. The inner surface of the cover sidewall 139 is suitably shaped to conform to the outer surface of the upper sidewall 121 of the base 105. When the cover 131 is on the base 105, the cover limits access to a label (not shown) on the upper sidewall 121 because the label is sandwiched between the upper sidewall of the base and the cover. It is understood that a label can be placed elsewhere within the display case 101 and be protected against tampering within the scope of the invention. Further, a label can placed on the exterior of the display case within the scope of the invention or omitted entirely whenever circumstances make absence of a tamper resistant label acceptable.

To use the display case 101, a person places a ball 11 (or other item) on the pedestal 151 of the base 105 and places the cover 131 over the top of the ball. The spring 155 will engage the ball 11 and secure the ball against the underside of the cover 131. The person then rotates the cover 131 relative to the base 105 to secure the cover to the base. At this point, the connection between the cover 131 and the base 105 is releasable. This allows the ball to be taken out of the display case for examination or to rotate the ball so it can be displayed in a different orientation.

It is understood that the display case 101 described above is just one example of the invention and that various modifications may be made without departing from the scope of the invention. For example, the size and shape of the various components of the display case can be changed to adapt the case to display different kinds of sports memorabilia. Further, the releasable connection between the cover and base can be modified from the bayonet connection 181 described above. For instance, the cover can be designed so translational movement (instead of rotational movement) of the cover moves one or more lugs into a narrower portion of an opening.

Referring to FIGS. 11-15, another embodiment of a display case of the present invention is generally designated at 201. The display case is a softball display case adapted to display a softball 211. The display case 201 is similar to the display case 101 of the previous embodiment except the display case 201 is sized to receive a standard softball 211. Additionally, a base 205 of the display case 201 is configured such that a pedestal 251 of the base includes a surface 253 defined by spring 255. The spring 255 comprises finger-type spring members 257 that extend from an edge margin of the pedestal 251 toward a center of the pedestal. In the illustrated embodiment, there are twenty spring members 257. However, other numbers of spring members 257 are envisioned without departing from the scope of the invention. Each spring member 257 comprises an elongate body that tapers from a wide base portion to a narrow free end of the spring member. In the illustrated embodiment, the free ends of the spring members 257 are rounded. However, the free ends of the spring members 257 can have other shapes without departing from the scope of the disclosure. As the spring members 257 extend from the base portion to the free end, the spring members bend downward toward a bottom of the base 205. As such, each spring member 257 includes a generally horizontally extending first portion 258, a second portion 260 bent downward from the first portion, and a third portion 262 bent slightly upward from the second portion. Collectively, the second portions and third portions 260, 262 of each of the spring members 257 define a recessed portion of the pedestal 251 for seating the softball 211.

The spring members 257 are circumferentially spaced around the pedestal 251. The spacing between the spring members 257 defines linear gaps 259 between the spring members. The linear gaps 259 extend from the outer edge margin of the pedestal 251 to the center of the pedestal where they converge at a center opening 261. The spring members 257 are configured to deflect downward when engaged by the softball 211 and apply an upward spring force to the ball to press the ball against an underside of the top 235 of the cover 231. The spring members 257 also apply inward spring forces to the ball to center the ball within an interior space 233 of the display case 201. The downward movement of the spring members 257 at least partially closes the linear gaps 259 and widens the center opening 261. The bias of the spring 255 to return to its natural state causes the upward and inward spring forces on the ball. It is envisioned that other spring configurations can be used without departing from the scope of the disclosure.

Referring to FIGS. 16-20, another embodiment of a display case of the present invention is generally designated at 301. The display case is a golf ball display case adapted to display a golf ball 311. The display case 301 is similar to the display case 201 of the previous embodiment except the display case 301 is sized to receive a standard golf ball 311. Additionally, a base 305 of the display case 301 is configured such that a pedestal 351 of the base includes a surface 353 defined by spring 355. The spring 355 comprises finger-type spring members 357 that extend from an edge margin of the pedestal 351 toward a center of the pedestal. In the illustrated embodiment, there are thirty-five spring members 357. However, other numbers of spring members 357 are envisioned without departing from the scope of the invention. Each spring member 357 comprises an elongate body that tapers from a wide base portion to a narrow free end of the spring member. In the illustrated embodiment, the free ends of the spring members 357 are generally squared off. However, the free ends of the spring members 357 can have other shapes without departing from the scope of the disclosure. As the spring members 357 extend from the base portion to the free end, the spring members extend generally horizontally.

The spring members 357 are circumferentially spaced around the pedestal 351. The spacing between the spring members 357 defines linear gaps 359 between the spring members. The linear gaps 359 extend from the outer edge margin of the pedestal 351 to the center of the pedestal where they converge at a center opening 361. The spring members 357 are configured to deflect downward when engaged by the golf ball 311 and apply an upward spring force to the ball to press the ball against an underside of the top 335 of the cover 331. The spring members 357 also apply inward spring forces to the ball to center the ball within an interior space 333 of the display case 301. The downward movement of the spring members 357 at least partially closes the linear gaps 359 and widens the center opening 361. The bias of the spring 355 to return to its natural state causes the upward and inward spring forces on the ball. It is envisioned that other spring configurations can be used without departing from the scope of the disclosure.

Additionally, a piece of acrylic 370 may be disposed on the underside of the cover 331 at the top 335 of the cover where the golf ball 311 engages the cover. This prevents the ball from directly contacting the cover 131. It also prevents at least a portion of the reflection of the ball 311 from being projected onto the cover 131.

Also, terms associated with a particular orientation, such as top, bottom, upper, lower, side, etc., are used in reference to the orientation of the display cases as illustrated in the drawings to facilitate understanding of the relation between various parts of the illustrated embodiments. It is understood that the display cases can have different orientations from what is illustrated within the scope of the invention. Further, modifications to the display cases can result in changes in orientations of various parts relative to one another without departing from the scope of the invention.

When introducing elements of the invention or the preferred embodiment(s) thereof, the articles "a". "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawings shall be interpreted as illustrative and not in a limiting sense.

What is claimed is:

1. A base assembly for a ball display case, the assembly comprising:

a base configured to support the display case on a surface; and a pedestal supported by the base and configured to support a ball in the display case, the pedestal including a generally circular platform for seating the ball in the display case, the platform including a spring configured to yield when contacted by the ball in the display case, wherein the spring comprises a plurality of spring members circumferentially spaced around the platform and extending from a base portion of the spring members at an outer edge margin of the platform to free ends of the spring members, wherein the spring members taper from the base portion to the free end such that the base portions comprise wider ends of the spring members, the wider ends of the spring members defining a perimeter of the platform, and wherein each spring member has a same size and shape, and wherein the spring members comprise spiral shaped spring members having rounded free ends.

2. A base assembly as set forth in claim 1 wherein the pedestal is integrally formed with the base.

3. A base assembly as set forth in claim 1 wherein the spring members comprise elongate projections extending from the outer edge margin of the platform.

4. A base assembly as set forth in claim 1 wherein the free ends form a center opening in the platform.

5. A base assembly as set forth in claim 1 wherein a spacing between the spring members forms gaps separating the spring members from immediately adjacent spring members.

6. A ball display case comprising:

a base configured to support the display case on a surface;

a pedestal supported by the base and configured to support a ball in the display case, the pedestal including a generally circular platform for seating the ball in the display case, the platform including a spring configured to yield when contacted by the ball in the display case, wherein the spring comprises a plurality of spring members circumferentially spaced around the platform and extending from a base portion of the spring members at an outer edge margin of the platform to a free end of the spring member, wherein the spring members taper from the base portion to the free end such that the base portions comprise wider ends of the spring members, the wider ends of the spring members defining a perimeter of the platform, and wherein each spring member has a same size and shape, and wherein the spring members comprise spiral shaped spring members having rounded free ends; and a cover supported by the base for covering the ball in the display case.

7. A display case as set forth in claim 6 wherein the pedestal is integrally formed with the base.

8. A display case as set forth in claim 6 wherein the spring members comprise elongate projections extending from the outer edge margin of the platform.

9. A display case as set forth in claim 6 wherein the free ends form a center opening in the platform.

* * * * *